US009139947B2

(12) United States Patent
Hayashi et al.

(10) Patent No.: US 9,139,947 B2
(45) Date of Patent: Sep. 22, 2015

(54) WASHING AND DRYING MACHINE FOR DEODORIZING AN OUTSIDE SPACE

(75) Inventors: Takahiko Hayashi, Osaka (JP); Hideyuki Ryohke, Osaka (JP); Yasuhiro Kuge, Osaka (JP); Hitoshi Morita, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 822 days.

(21) Appl. No.: 13/383,369

(22) PCT Filed: Jun. 21, 2010

(86) PCT No.: PCT/JP2010/060436

§ 371 (c)(1),
(2), (4) Date: Jan. 10, 2012

(87) PCT Pub. No.: WO2011/016293

PCT Pub. Date: Feb. 10, 2011

(65) Prior Publication Data

US 2012/0111066 A1 May 10, 2012

(30) Foreign Application Priority Data

Aug. 5, 2009 (JP) ..... 2009-182120
Aug. 5, 2009 (JP) ..... 2009-182122

(51) Int. Cl.

*D06F 58/20* (2006.01)
*D06F 25/00* (2006.01)
*D06F 35/00* (2006.01)

(52) U.S. Cl.

CPC ..... *D06F 58/203* (2013.01); *D06F 25/00* (2013.01); *D06F 35/003* (2013.01)

(58) Field of Classification Search

CPC ..... D06F 35/003; D06F 25/00; D06F 18/00; D06F 58/203; D06F 58/20

See application file for complete search history.

(56) References Cited

U.S. PATENT DOCUMENTS

2004/0216326 A1* 11/2004 Kitamura et al. ..... 34/597
2008/0252189 A1* 10/2008 Regan ..... 312/249.8

FOREIGN PATENT DOCUMENTS

| | | | |
|---|---|---|---|
| JP | 2006-57942 | A | 3/2006 |
| JP | 2007-259978 | A | 10/2007 |
| JP | 2009-34187 | A | 2/2009 |
| JP | 2009-66054 | A | 4/2009 |
| JP | 2009-66217 | A | 4/2009 |

* cited by examiner

*Primary Examiner* — Jason Ko
*Assistant Examiner* — Spencer Bell
(74) *Attorney, Agent, or Firm* — Birch, Stewart, Kolasch & Birch, LLP

(57) ABSTRACT

Provided is a washing and drying machine (1), including: a dewatering tub (30); a blower path (71) leading to the dewatering tub (30); another blower path (81) leading to an outside of the washing and drying machine; an ion generator (75) for generating ions having sterilizing and deodorizing actions, the ion generator (75) being arranged on the blower path (71); blower means (70) for blowing the ions generated from the ion generator (75); blower-path switching means (76) for switching the blower path leading to the dewatering tub (30) and the another blower path leading to the outside of the washing and drying machine to each other; and control means (51) for activating the ion generator (75), the blower means (70), and the blower-path switching means (76) in a predetermined mode based on an operation condition of the washing and drying machine (1).

8 Claims, 17 Drawing Sheets

WASHING AND DRYING MACHINE FOR DEODORIZING AN OUTSIDE SPACE

TECHNICAL FIELD

The present invention relates to a washing and drying machine.

BACKGROUND ART

Conventionally, there has been proposed a washing and drying machine provided with an ion generator for generating ions having sterilizing and deodorizing actions so as to exert functions of removing odor that has adhered to clothing and killing saprophytic bacteria and the like by supplying the ions having sterilizing and deodorizing actions into a dewatering tub (drum) accommodating the clothing (refer to Patent Literature 1). Unlike ozone, the ions are odor-free and harmless to a human body, and in addition, have been confirmed to be effective for removing odor and fungi such as mold grown on (adhering to) a wall.

In recent years, along with increasing awareness of health and cleanliness, more and more users hope removal of odor caused by humidity and of mold fungi from a sanitary space in which a washing and drying machine is installed. In this context, the most general sanitary space in which a washing and drying machine is installed is a lavatory adjacent to a bathroom. The space for the lavatory is adjacent to a bathroom, and is smaller in floor area than living spaces such as a dwelling room and a living room. For such reasons, the washing and drying machine is in an environment which is humid and liable to be odorous and moldy.

Further, when being not operated, the washing and drying machine is generally used as a container for dirty washing objects that have been taken off and not yet been washed. Thus, there is a problem that odor is caused by the dirty washing objects that have been put in a dewatering tub and fills the sanitary space.

CITATION LIST

Patent Literature

Patent Literature 1: JP 2009-66217 A

SUMMARY OF INVENTION

Technical Problems

However, the above-mentioned washing and drying machine disclosed in Patent Literature 1 is not intended for positive discharge of ions to an outside, but intended for sterilizing and deodorizing effects with respect to clothing and the like accommodated in the dewatering tub. Thus, the washing and drying machine cannot be expected to remove mold in a lavatory. Under present circumstances, in order to remove mold, time and effort are required for frequent cleaning with use of chlorine-based chemicals, which may leads problems of pungent odor of the chlorine-based chemicals and heavier burden of housework.

Under the circumstances, an air-outlet port for positively discharging ions to the outside of the machine needs to be provided through an outer casing. However, generally, washing and drying machines are installed in close contact with a wall surface provided with a water tap, and hence installation places are restricted. Therefore, it is difficult to overcome such a restriction merely by providing the air-outlet port to face a space outside the machine through the outer casing, and ions cannot be sufficiently supplied to places which are liable to be moldy (for example, the periphery of a bathroom door or around water taps). Consequently, an effect of suppressing mold cannot be satisfactorily obtained.

The present invention has been made in view of the above-mentioned conventional problems. It is an object of the present invention to provide a washing and drying machine capable of efficiently removing odor and saprophytic bacteria in an installation space for the washing and drying machine (outside the machine), such as a lavatory, by discharging ions into the space outside the machine, the ions being generated by an ion generator, having sterilizing and deodorizing effects, and being harmless to a human body.

Solution to Problems

In order to achieve the above-mentioned object, a washing and drying machine according to the present invention includes: an outer casing; a dewatering tub arranged in the outer casing; a drying unit which is arranged in an upper portion in the outer casing, and includes a heater and a blower fan accommodated in a blower box having an air-intake port and an air-exhaust port, the blower fan being driven to deliver air heated by the heater into the dewatering tub; an ion generator for generating ions having sterilizing and deodorizing actions into an airflow to flow in a flow path, the ion generator being mounted to the blower box; a vent provided through the blower box and opened vertically toward a flow path on a downstream side of the ion generator and on an upstream side of the heater; and an air-outlet tube connected to the vent and having an air-outlet port to substantially horizontally face a space outside the washing and drying machine, wherein the air-outlet tube is mounted to a top plate of the outer casing in an axially turnable manner.

According to this structure, when the ion generator is activated and the blower fan is driven, the ions having sterilizing and deodorizing actions are generated from the ion generator. Then, the ions are mixed into the air to flow in the flow path, and the ion wind thus generated flows through the vent into the air-outlet tube mounted to the top plate of the outer casing. As a result, the ion wind is delivered to the space outside the washing and drying machine from the air-outlet port substantially horizontally facing the space outside the washing and drying machine. By axially turning the air-outlet tube, a directional angle of the air-outlet port varies. Thus, a blow-out direction of the ion wind is freely variable at 360° horizontally, and hence sufficient ions can be efficiently supplied to places in the space outside the washing and drying machine, which are liable to be moldy. As a result, an effect of removing mold can be enhanced.

Further, in the present invention, the washing and drying machine structured as described above further includes: a disk body for holding the air-outlet tube; and a disk-body receiving portion formed on the top plate of the outer casing and having an insertion hole for the air-outlet tube, the insertion hole being provided at a center thereof, in which the air-outlet tube is passed through the insertion hole, and in which the disk body is turnably mounted to the disk-body receiving portion.

According to this structure, the air-outlet tube is passed through the insertion hole at the center of the disk-body receiving portion, and the disk body fixed to the air-outlet tube is turnably mounted to the disk-body receiving portion. In this way, together with the disk body, the air-outlet tube is mounted to the top plate of the outer casing so as to be turnable in the axial direction. Simultaneously, the air-outlet tube provided to the blower box is connected. Therefore, the air-outlet tube can be easily mounted and connected from the outside of the washing and drying machine. Further, the air-outlet tube can be mounted and removed from the outside of the washing and drying machine, and hence the air-outlet tube can be easily cleaned and replaced.

Further, in the present invention, the washing and drying machine structured as described above further includes an air-outlet-port cover including a diffuser to face the air-outlet port, in which the air-outlet-port cover is axially supported with respect to the disk body by a horizontal shaft.

According to this structure, by turning the air-outlet-port cover about the horizontal shaft, the elevation angle of the diffuser can be changed. Thus, the blow-out direction of the ion wind is freely variable also in a vertical direction, and hence sufficient ions can be more efficiently supplied to places in the space outside the washing and drying machine, which are liable to be moldy. As a result, the effect of removing mold can be further enhanced.

Further, in the present invention, in the washing and drying machine structured as described above, the disk body has a void in which a periphery of the air-outlet port of the air-outlet tube is accommodated, the void being formed by opening a lower surface of the disk body, the disk-body receiving portion includes: an annular support wall for supporting an outer peripheral portion of the disk body; and an annular bank wall circumferentially provided on an inner side of the annular support wall, the disk-body receiving portion includes a water path for water to intrude into the void, the water path being formed in a bottom surface of a part of the disk-body receiving portion, the part being surrounded by the annular support wall and the annular bank wall, and the disk-body receiving portion includes a drain hole to be opened to an outside of the washing and drying machine, the drain hole being formed at one point on the water path.

According to this structure, even when water intrudes into the void in the disk body from a gap between the air-outlet-port cover and the disk body and from the diffuser, as long as a height of the bank wall is not exceeded, the water is drained from the drain hole to the outside of the machine through the water path of the disk-body receiving portion. Therefore, the water is prevented from intruding into the drying unit.

Further, in the present invention, in the washing and drying machine structured as described above, the air-exhaust port is opened in a lower surface of the blower box, and a bottom surface of the flow path in the blower box is formed to have a gradient that becomes lower in a range from immediately below the vent toward the air-exhaust port.

According to this structure, even when water in the water path overflows the bank wall and intrudes into the drying unit through the air-outlet tube, or when water jumps directly into the air-outlet port from the diffuser and then similarly intrudes into the drying unit through the air-outlet tube, water that has dropped immediately below the vent flows down to the air-exhaust port along the gradient of the bottom surface of the flow path in the blower box. Then, the water is drained from the air-exhaust port into the dewatering tub. Thus, the drying unit is prevented from suffering from failures caused by water pooled in the flow path.

In order to achieve the above-mentioned object, a washing and drying machine according to the present invention includes: a dewatering tub; a blower path leading to the dewatering tub; another blower path leading to an outside of the washing and drying machine; an ion generator for generating ions having sterilizing and deodorizing actions, the ion generator being arranged on the blower path; blower means for blowing the ions generated from the ion generator; blower-path switching means for switching the blower path leading to the dewatering tub and the another blower path leading to the outside of the washing and drying machine to each other; and control means for activating the ion generator, the blower means, and the blower-path switching means in a predetermined mode based on an operation condition of the washing and drying machine.

According to this structure, at the time of blowing the ions with the blower means, which are generated from the ion generator and have sterilizing and deodorizing actions, the ions can be blown into the space outside the washing and drying machine by switching the blower path leading to the dewatering tub to the another blower path leading to the outside of the washing and drying machine with the blower-path switching means. Thus, sterilization and deodorization outside the washing and drying machine can be performed by actions of the ions having sterilizing and deodorizing actions.

Further, in the present invention, in the washing and drying machine structured as described above, the ions are blown into the dewatering tub during an operation of washing, an operation of dewatering, or an operation of drying, and the ions are blown into a space outside the washing and drying machine after the operation of washing, the operation of dewatering, or the operation of drying.

According to this structure, sterilization and deodorization in the dewatering tub can be performed during the operation of washing, the operation of dewatering, or the operation of drying, and sterilization and deodorization outside the washing and drying machine can be performed after the operation of washing, the operation of dewatering, or the operation of drying.

Further, in the present invention, in the washing and drying machine structured as described above, the ions are blown into the dewatering tub during an operation of washing, an operation of dewatering, or an operation of drying, the ions are blown into the dewatering tub after the operation of washing or the operation of dewatering, and the ions are blown into a space outside the washing and drying machine after the operation of drying.

According to this structure, sterilization and deodorization in the dewatering tub can be performed during the operation of washing, the operation of dewatering, or the operation of drying and after the operation of washing or the operation of dewatering, and the ions can be blown into the space outside the washing and drying machine after the operation of drying.

Further, in the present invention, the washing and drying machine structured as described above further includes operation-mode switching means for switching operation-mode settings of ion-blowing operations so that an independent-operation mode in which the ion-blowing operations are separately performed independently of the operation of washing, the operation of dewatering, or the operation of drying is selectable.

According to this structure, independently of the operation of washing, the operation of dewatering, or the operation of drying, sterilization and deodorization in the dewatering tub or sterilization and deodorization outside the washing and drying machine can be arbitrarily performed by a user.

Further, in the present invention, the washing and drying machine structured as described above further includes blower-path changing means for changing settings of the blower path leading to the dewatering tub and the another blower path leading to the outside of the washing and drying machine so that, in the independent-operation mode of the ion-blowing operations, whether the ions are blown into the dewatering tub or the ions are blown into the space outside the washing and drying machine is selectable. Further, the ions may be allowed to be blown into the space outside the washing and drying machine during the operation of washing or the operation of dewatering.

Further, in the present invention, the washing and drying machine structured as described above further includes operation-mode switching means for switching operation-mode settings of ion-blowing operations, in which the control means performs the ion-blowing operations independently of the operation of washing, the operation of dewatering, or the operation of drying when the independent-operation mode of the ion-blowing operations is selected by the operation-mode switching means.

Further, in the present invention, the washing and drying machine structured as described above further includes: time-keeping means; time setting means; and regular-operation setting means for scheduling regular execution of the independent-operation mode of the ion-blowing operations, the independent-operation mode of the ion-blowing operations being executed every day at a fixed time set by a user. According to this structure, the ion-blowing operations are automatically performed every day at a fixed time. In this way, sterilization and deodorization in the dewatering tub or sterilization and deodorization outside the washing and drying machine can be regularly performed.

Further, in the present invention, the washing and drying machine structured as described above further includes: humidity detecting means for detecting humidity in the dewatering tub or humidity in the space outside the washing and drying machine; and regular-operation setting means for scheduling regular execution of the independent-operation mode of the ion-blowing operations, the independent-operation mode of the ion-blowing operations being appropriately executed when humidity at which mold is liable to develop is detected. According to this structure, the humidity at which mold is liable to develop is detected, and the ion-blowing operations are automatically and appropriately executed. In this way, sterilization and deodorization in the dewatering tub or sterilization and deodorization outside the washing and drying machine can be regularly performed.

Further, in the present invention, the washing and drying machine structured as described above further includes: temperature detecting means for detecting temperature in the dewatering tub or temperature in the space outside the washing and drying machine; and regular-operation setting means for scheduling regular execution of the independent-operation mode of the ion-blowing operations, the independent-operation mode of the ion-blowing operations being appropriately executed when temperature at which mold is liable to develop is detected. According to this structure, the temperature at which mold is liable to develop is detected, and the ion-blowing operations are automatically and appropriately executed. In this way, sterilization and deodorization in the dewatering tub or sterilization and deodorization outside the washing and drying machine can be regularly performed.

Further, in the present invention, the washing and drying machine structured as described above further includes: odor detecting means for detecting odor in the dewatering tub or odor in the space outside the washing and drying machine; and regular-operation setting means for scheduling appropriate execution of the independent-operation mode of the ion-blowing operations, the independent-operation mode of the ion-blowing operations being appropriately executed when odor of a predetermined value or more is detected. According to this structure, the odor in the dewatering tub or the odor outside the washing and drying machine is detected, and the ion-blowing operations are automatically and appropriately executed. In this way, sterilization and deodorization in the dewatering tub or sterilization and deodorization outside the washing and drying machine can be regularly performed.

Advantageous Effects of Invention

According to the washing and drying machine of the present invention, the blow-out direction of the ion wind is variable, and hence sufficient ions can be efficiently supplied to places in the space outside the washing and drying machine, which are liable to be moldy. As a result, the effect of removing mold can be enhanced.

Further, according to the washing and drying machine of the present invention, odor and saprophytic bacteria in an installation space for the washing and drying machine (outside the washing and drying machine), such as a lavatory, can be efficiently removed by discharging ions into the space outside the machine, the ions being generated by the ion generator, having sterilizing and deodorizing effects, and being harmless to a human body.

DESCRIPTION OF EMBODIMENT

Figure 1:
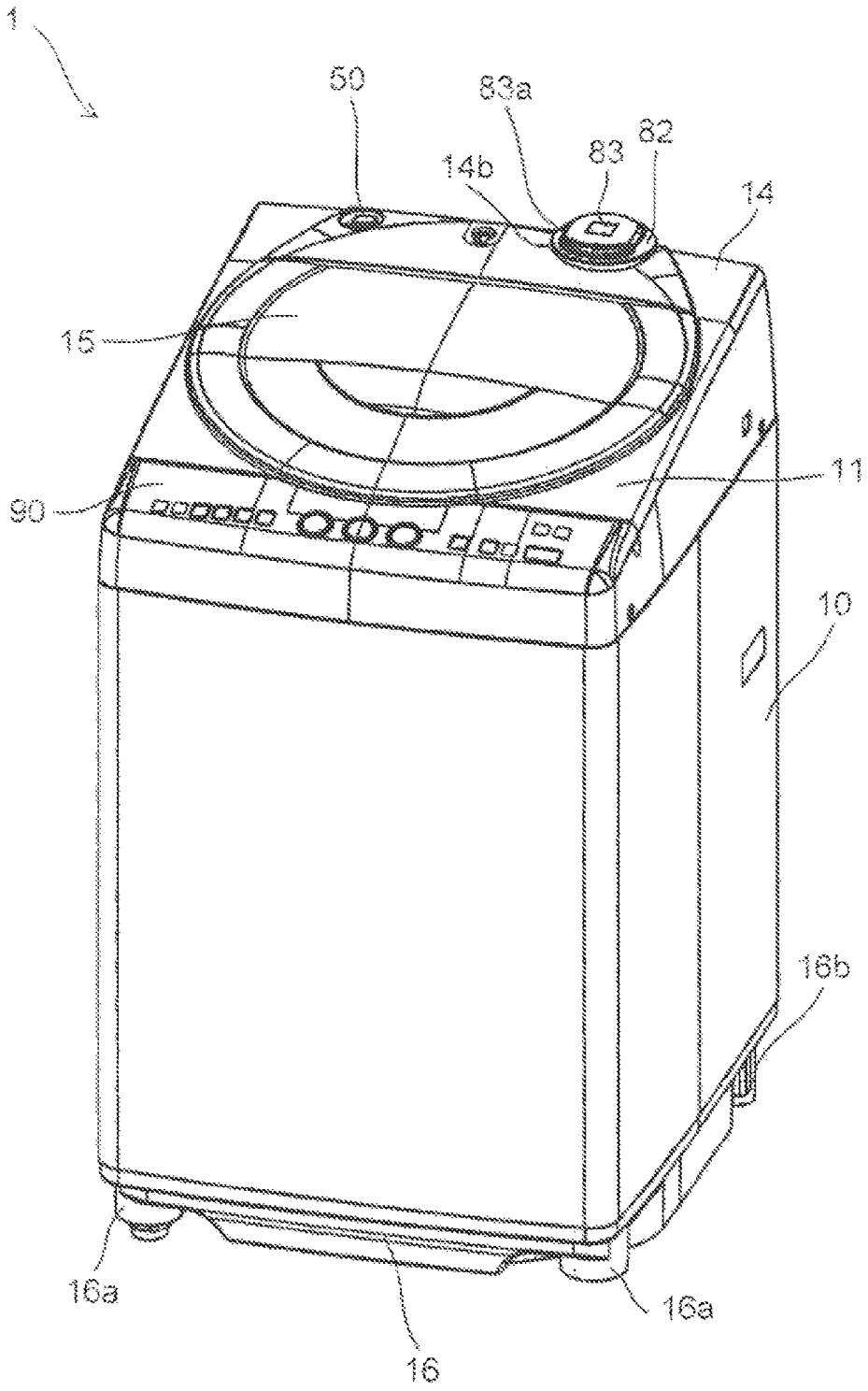
FIG. 1 is a perspective view in which the front of a washing and drying machine according to an embodiment of the present invention is viewed from obliquely above.
Figure 2:
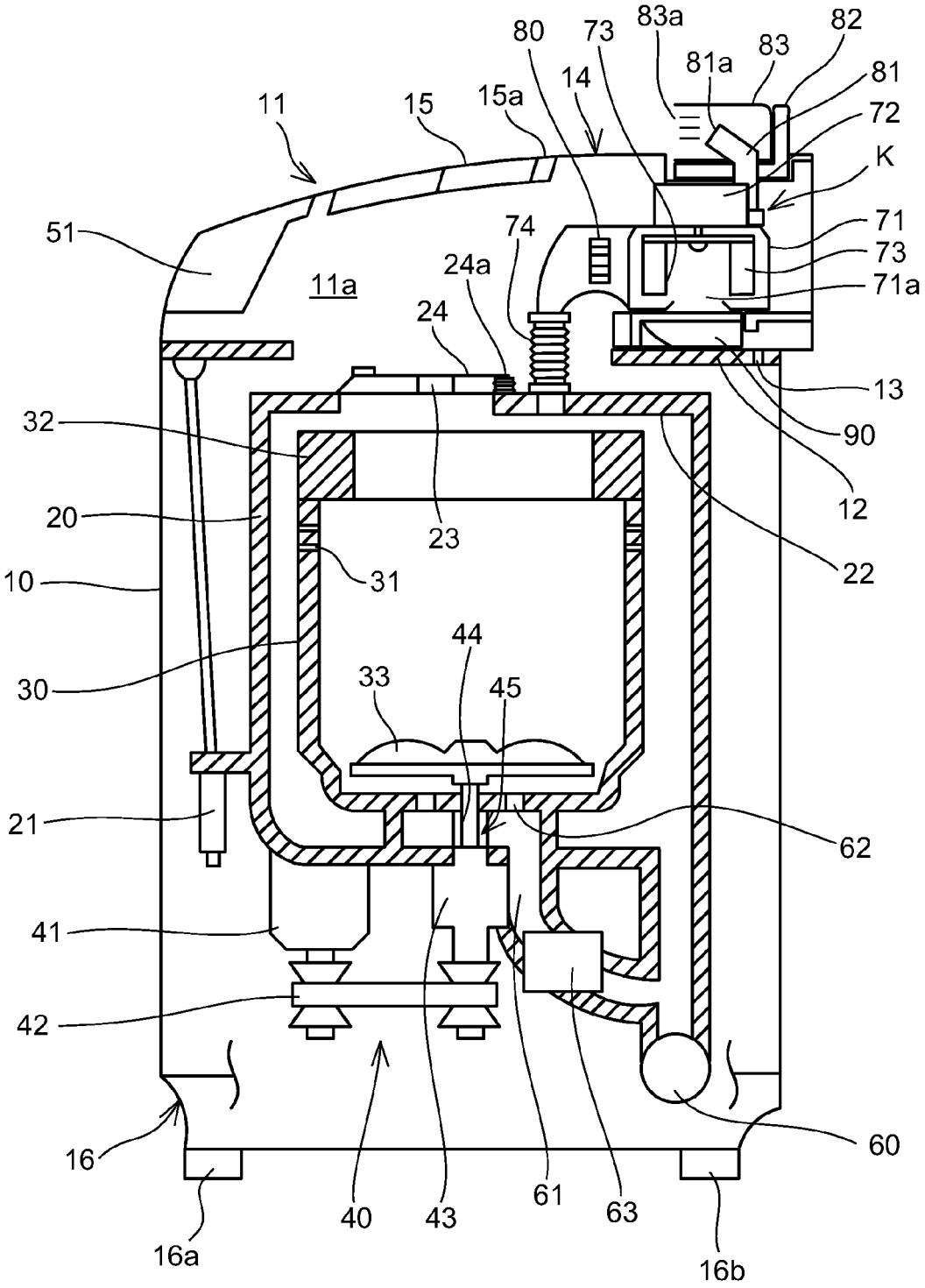
FIG. 2 is a schematic vertical sectional view in which the washing and drying machine is viewed from a lateral side.

In the following, detailed description is made of an embodiment of the present invention with reference to the drawings. FIG. 1 is a perspective view in which the front of a washing and drying machine according to the embodiment of the present invention is viewed from obliquely above. FIG. 2 is a schematic vertical sectional view in which the washing and drying machine is viewed from a lateral side. A front surface and a rear surface of the washing and drying machine illustrated in FIGS. 1 and 2, which has a washing function, are respectively on a left side and a right side of FIG. 2. The washing and drying machine is a full-automatic type washing and drying machine, and includes an outer casing 10 made of a metal or a synthetic resin. The outer casing 10 is molded in a substantially rectangular-parallelepiped shape, and both upper and lower sides thereof are opened. To an upper open portion of the outer casing 10, an upper surface plate 11, which is made of a synthetic resin and to which an operating portion 90 and the like are mounted, is fixed with male screws. Further, on an upper inside of the outer casing 10, there is provided an annular support plate 12 for supporting a water tub 20 and blower means 70 (which are described below). A through-hole 13 for introducing air in the outer casing 10 to the blower means is provided through the support plate 12. The upper surface plate 11 forms a top plate of the outer casing 10.

On the rear surface side of the washing and drying machine, a back panel 14 made of a synthetic resin is fixed to the outer casing 10 or the upper surface plate 11 with male screws, and an upper lid 15 is movably arranged between the back panel 14 and the upper surface plate 11. The back panel 14 also forms the top plate of the outer casing 10.

To a lower open portion of the outer casing 10, a quadrangular base 16 made of a synthetic resin is fixed with male screws. At four corners of the base 16, there are provided leg portions 16*a* and 16*b* for supporting the outer casing 10 on a floor. The leg portions 16*a* on the front surface side are adjustable legs variable in height for the purpose of leveling, and the leg portions 16*b* on the rear surface side are fixed legs molded integrally with the base 16.

A washing-object inlet port 11*a* through which washing objects are put into the washing and drying machine is formed through the upper surface plate 11. The upper lid 15 for opening and closing the washing-object inlet port 11*a* is coupled to a front end portion of the back panel 14 with a hinge portion 15*a* so as to be turnable in a perpendicular plane. In a closed state as illustrated in FIG. 2, the upper lid 15 covers the washing-object inlet port 11*a* from above. The outer water tub 20 and an inner dewatering tub 30 are arranged inside the outer casing 10.

The water tub 20 is supported in a suspended manner by a plurality of suspension members 21 from the support plate 12 so as to be rockable in a horizontal plane. Further, the dewatering tub 30 is disposed on an inner side of the water tub 20 concentrically with the water tub 20, and serves also as a washing tub. Each of the water tub 20 and the dewatering tub 30 has a shape of cylindrical cup opened on an upper side, and an axial line thereof extends along a vertical direction.

The dewatering tub 30 has a tapered peripheral wall gradually widened upward. No opening portion for passing liquid is formed through the peripheral wall other than a plurality of dewatering holes 31 annularly arranged at an uppermost portion thereof, and hence the dewatering tub 30 is what is called a "hole-free" type dewatering tub. An annular balancer 32 is mounted along a rim of an upper open portion of the dewatering tub 30. The balancer 32 has a function of suppressing vibration of the dewatering tub 30 at the time of high-speed rotation thereof for dewatering washing objects. Stirring blades 33 for fluidizing washing water and rinsing water in the tub are arranged on an inner bottom surface of the dewatering tub 30.

A flange portion 22 is extended inward at an upper end portion of the water tub 20, and an inner lid 24 provided with an exhaust air filter 23 is mounted to the flange portion 22 with a hinge 24*a* so as to be turnable. The inner lid 24 prevents washing objects and water from jumping out of the dewatering tub 30 during washing, rinsing, and dewatering.

A drive unit 40 is mounted to a lower portion of the water tub 20. The drive unit 40 includes a drive motor 41, a belt transmission mechanism 42 for transmitting rotation output from the drive motor 41, and a clutch-and-brake mechanism 43. From a central portion of the drive unit 40, a cylindrical dewatering shaft 44 and a stirring-blade shaft 45 project upward.

The dewatering shaft 44 and the stirring-blade shaft 45 form a dual shaft structure in which the dewatering shaft 44 is arranged on the outer side and the stirring-blade shaft 45 is arranged on the inner side. The dewatering shaft 44 is inserted upward from below into the water tub 20, and then coupled to the dewatering tub 30 so as to support the dewatering tub 30. The stirring-blade shaft 45 is further inserted upward from below into the dewatering tub 30 by passing through the water tub 20, and then coupled to the stirring blades 33 so as to support the stirring blades 33. The stirring blades 33 are rotated at from 55 to 300 rpm so as to perform washing or rinsing, and during dewatering, the stirring blades 33 are rotated at from 0 to 1,000 rpm together with the dewatering tub 30 so as to perform dewatering. Between the dewatering shaft 44 and the water tub 20 and between the dewatering shaft 44 and the stirring-blade shaft 45, there are respectively arranged sealing members for preventing water leakage.

There is a space between the support plate 12 and the back panel 14, and a water supply valve (not shown) which is electromagnetically opened and closed is arranged in the space. A water supply hose for supplying clean water such as tap water is connected to a connecting pipe 50 which is connected to the water supply valve and projects upward in a manner of vertically passing through the back panel 14. Further, the water supply valve is connected to a vessel-like water supply port arranged at a position at which the vessel-like water supply port faces the inner side of the dewatering tub 30.

A drain hose 60 for draining water in the water tub 20 and the dewatering tub 30 to the outside of the outer casing 10 is mounted to a bottom portion of the water tub 20. Water flows into the drain hose 60 from a drain port 61 communicating to the bottom portions of the water tub 20 and the dewatering tub 30. Water that has flown out from the dewatering tub 30 at the time of dewatering is drained from the drain hose 60 through a drain pipe (not shown).

Drain holes 62 are circumferentially provided at four points in the dewatering tub 30, and the drain holes 62 each introduce the water in the dewatering tub 30 from the drain port 61 onto a drain valve 63 which is electromagnetically opened and closed.

With the above-mentioned structure, at the time of washing during which the rotary blades 33 are rotated, the water in the dewatering tub 30 is stopped with the drain valve 63 and stored in the dewatering tub 30. At the time of performing dewatering, the drain valve 63 is opened, and the water in the dewatering tub 30 is drained to the outside. At this time, among the dewatering shaft 44, the stirring-blade shaft 45, and the dewatering tub 30 which are rotated by the drive motor 41, the dewatering shaft 44 and the stirring-blade shaft 45 are rotatable relative to each other, and a water-tight structure is maintained.

A control circuit (control means) 51 is arranged on the front surface side of the outer casing 10. The control circuit 51 is arranged on a lower side of the upper surface plate 11. The control circuit 51 receives a control command from a user through intermediation of the operating portion 90 provided on an upper surface of the upper surface plate 11, and issues an operation command to the drive unit 40, the water supply valve, and the drain valve 63. Further, the control circuit 51 also issues a display command signal to an operation/display portion.

Figure 3A:
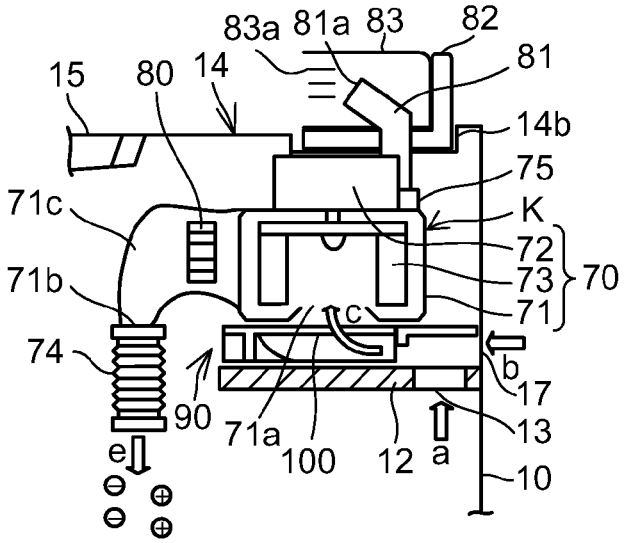
FIG. 3 are schematic vertical sectional views in each of which a structure of a main part around a drying unit of the washing and drying machine is viewed from a lateral side. Specifically, together with the structure, FIG. 3(*a*) illustrates a flow direction of ion wind during an in-tub ion-blowing operation, FIG. 3(*b*) illustrates a flow direction of the ion wind during an outward ion-blowing operation, and FIG. 3(*c*) illustrates flow directions of the ion wind during an in-tub-and-outward ion-blowing operation.
Figure 3B:
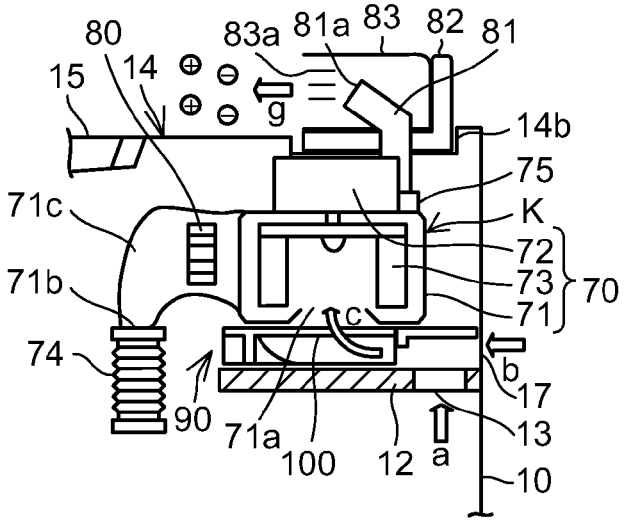
Figure 3C:
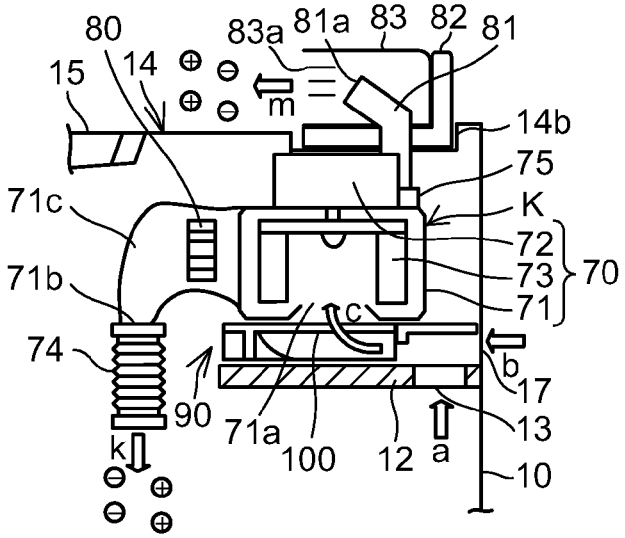
Figure 4A:
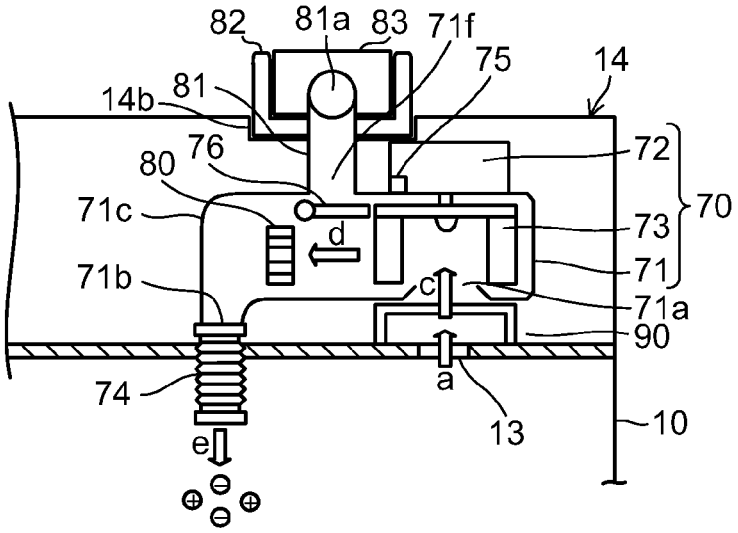
FIG. 4 are schematic vertical sectional views in each of which the structure of the main part around the drying unit of the washing and drying machine is viewed from a front side. Specifically, together with the structure, FIG. 4(*a*) illustrates the flow direction of the ion wind during the in-tub ion-blowing operation, FIG. 4(*b*) illustrates the flow direction of the ion wind during the outward ion-blowing operation, and FIG. 4(*c*) illustrates the flow directions of the ion wind during the in-tub-and-outward ion-blowing operation.
Figure 4B:
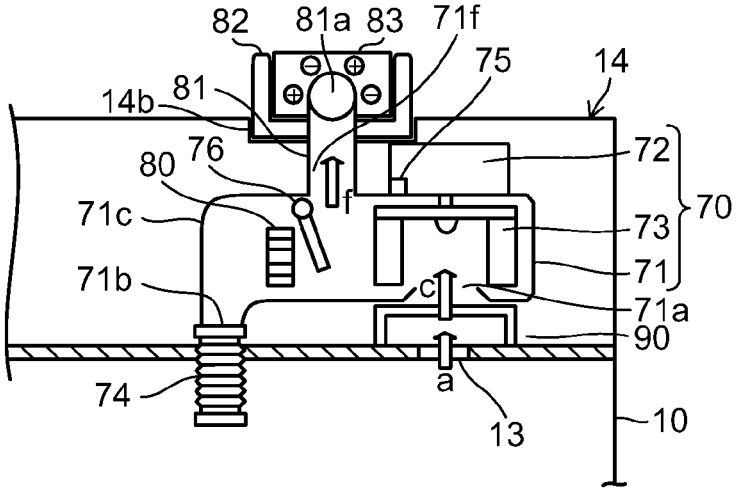
Figure 4C:
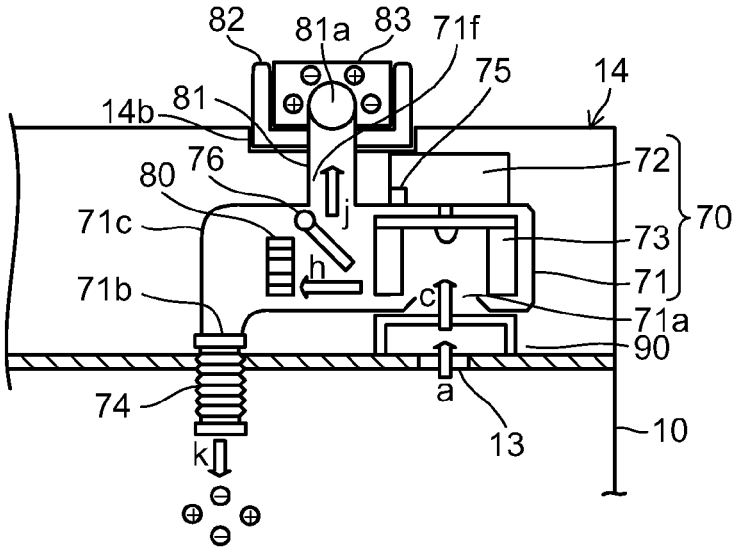

FIG. 3 are schematic vertical sectional views in each of which a structure of a main part around a drying unit of the washing and drying machine is viewed from a lateral side. FIG. 4 are schematic vertical sectional views in each of which the structure of the main part around the drying unit of the washing and drying machine is viewed from a front side. As illustrated in FIG. 3 and FIG. 4, in the space between the support plate 12 and the back panel 14 of the outer casing 10, there are provided a drying unit K, a filter 100 as foreign-matter removing means, and a foreign-matter accommodating box 90.

The drying unit K includes the blower means 70 and a heater 80 as heating means, and heats air, which is caused to flow through a flow path by driving the blower means 70, with the heater 80 and delivers the heated air into the dewatering tub 30. The filter 100 as foreign-matter removing means is provided to prevent foreign matter such as dust from an air-intake port 71*a* from entering into a blower box 71. Further, the foreign-matter accommodating box 90 is provided to accommodate foreign matter removed by the filter 100. The filter 100 is mounted to the foreign-matter accommodating box 90, and the foreign-matter accommodating box 90 is arranged on an air-inlet path of the blower means 70.

The blower means 70 includes the blower box 71 having the air-intake port 71*a* and an air-exhaust port 71*b*, and a blower fan 73 to be driven by a fan motor 72 and disposed inside the blower box 71 in a manner that a rotary shaft thereof vertically extends. In this embodiment, as the blower fan 73, there is used a centrifugal fan (for example, sirocco fan) which takes in air from a lower plane thereof into an axial direction and sends the air into a tangential direction of an outer periphery thereof.

The air-intake port 71*a* communicates to the through-hole 13 opened through the support plate 12 and an open portion 17 opened through a rear surface of the outer casing 10. The heater 80 as heating means for heating the air blown by the blower fan 73 is arranged in the flow path inside a duct 71*c*. Further, one end of a bellows tube 74 having another end to face the inner side of the dewatering tub 30 is connected to the air-exhaust port 71*b* at a leading end of the duct 71*c*. The another end of the bellows tube 74 is fitted into a fitting hole opened through the flange portion 22. The duct 71*c* and the bellows tube 74 constitute an air-exhaust path (blower path) leading to the dewatering tub 30.

Figure 5:
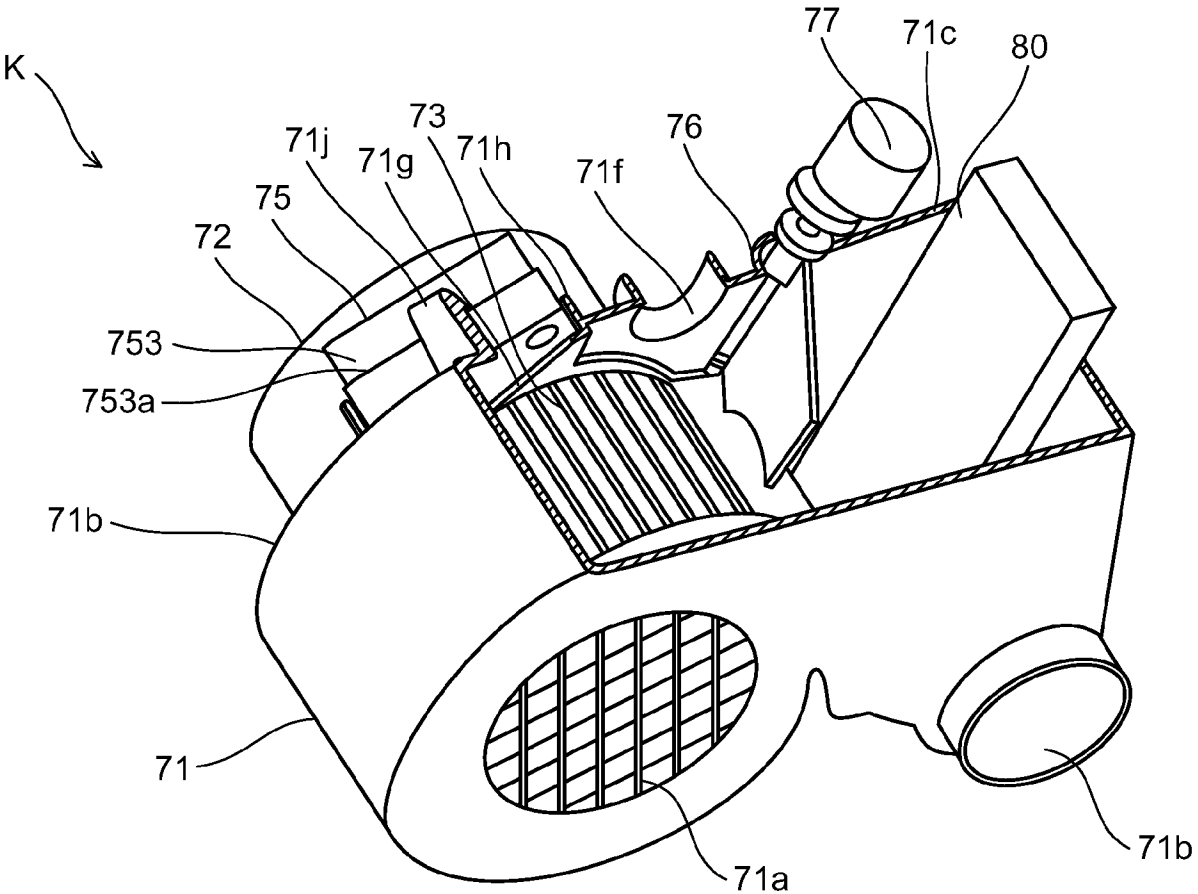
FIG. 5 is a perspective view in which the rear of the drying unit is viewed from obliquely below, illustrating a partially cutout blower box.

FIG. 5 is a perspective view in which the rear of the drying unit is viewed from obliquely below, illustrating a partially cutout blower box. As illustrated in FIG. 5, the blower box 71 includes a cylindrical portion 71*d* opened downward, and the duct 71*c* continuous with one side in a circumferential direction of the cylindrical portion 71*d*. The open portion on the lower side of the cylindrical portion 71*d* is defined as the air-intake port 71*a*, and the fan motor 72 is supported on an outer portion of an upper wall of the cylindrical portion 71*d*. The blower box 71 is arranged above the support plate 12 in an isolated manner, and the air-intake port 71*a* faces the support plate 12. The air-exhaust port 71*b* is opened through a lower surface at the leading end of the duct 71*c*.

Figure 6:
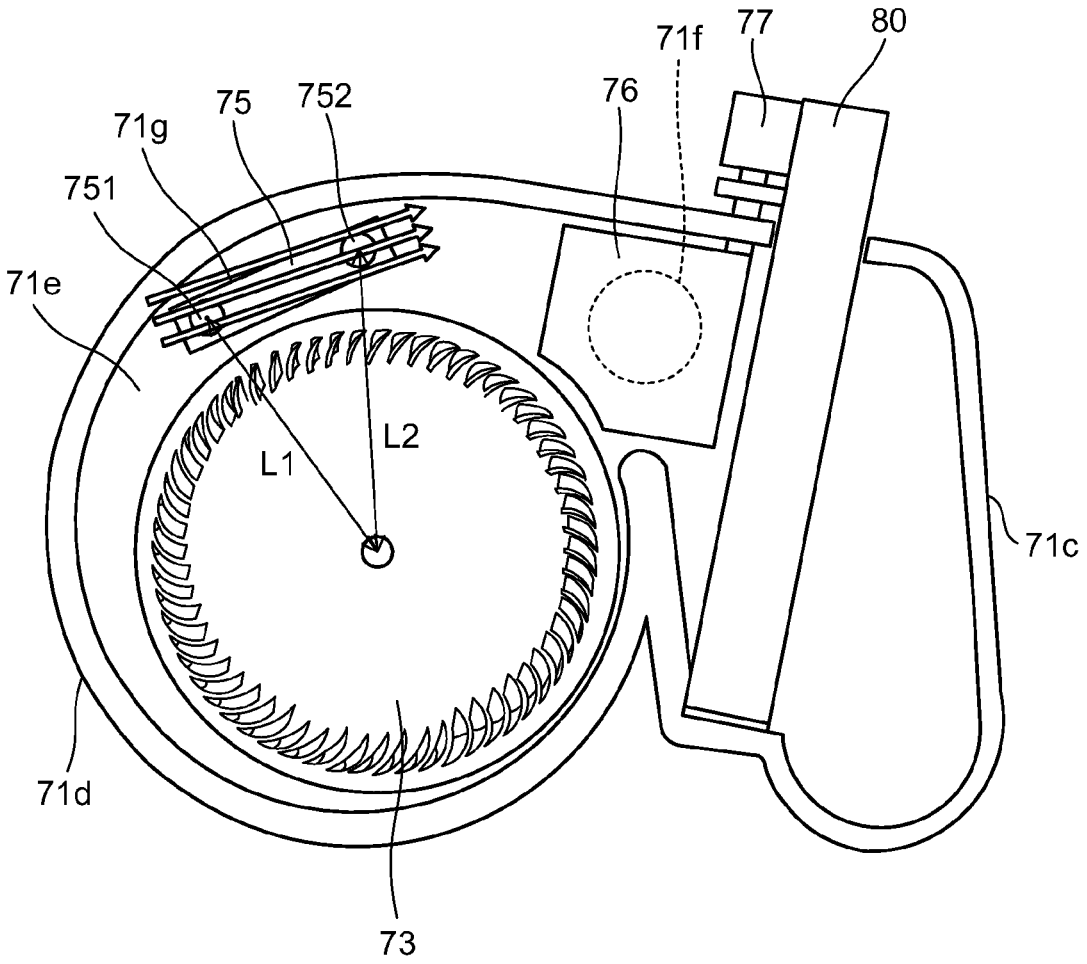
FIG. 6 is a lateral sectional view in which the drying unit is viewed from below.

FIG. 6 is a lateral sectional view in which the drying unit is viewed from below. As illustrated in FIG. 6, an outer periphery of the cylindrical portion 71*d* of the blower box 71 is not perfectly circular, but is spiral so as to gradually increase in distance from a center. With this, inside the cylindrical portion 71*d*, a circular-arc flow path 71*e*, which becomes gradually wider in a rotational direction of the blower fan 73, is formed around the blower fan 73. A space for disposing additional components can be easily secured in a wide downstream portion of the circular-arc flow path 71*e*. In the downstream portion, an ion generator 75 as ion generating means, a vent 71*f* as air-exhaust-path (blower-path) branching means, and a damper 76 as air-exhaust-path (blower-path) switching means are arranged in a concentrated manner. As described below, an air-outlet tube 81 having an air-outlet port 81*a* to face the outside of the machine is connected to the vent 71*f* by fitting.

An outward ion-discharge mechanism is formed of the blower means 70 (blower box 71, blower fan 73, and fan motor 72), the ion generating means (ion generator 75), the air-exhaust-path switching means (damper 76 and damper control motor 77), the air-exhaust-path branching means (vent 71*f*), the air-exhaust path leading to the air-outlet port 81*a* (blower path leading to the outside of the machine) (air-outlet tube 81), and the air-outlet port 81*a*.

In this embodiment, in the wide downstream portion of the circular-arc flow path 71*e* of the blower box 71, in which the space for disposing additional components is easily secured, the ion generating means, the air-exhaust-path switching means, and the air-exhaust-path branching means of the outward ion-discharge mechanism are arranged in a concentrated manner. Further, the blower means of the outward ion-discharge mechanism is capable of doubling as the blower means 70 that has already been provided to the drying unit K. Thus, almost all the components of the outward ion-discharge mechanism can be unified in the drying unit K. The unification can be achieved with only a small change of a molding die for the blower box 71, and changes in entire shape and size of the drying unit K can be minimized. Therefore, the outward ion-discharge mechanism can be compactly formed at low cost.

Figure 7:
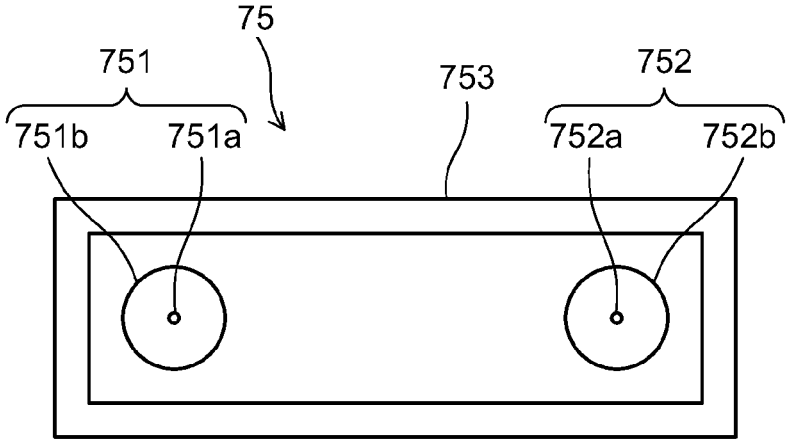
FIG. 7 is a bottom view of an ion generator.

FIG. 7 is a bottom view of the ion generator. As illustrated in FIG. 7, the ion generator 75 includes two ion generating portions 751 and 752 arranged separately and independently at a distance by which insulation therebetween can be secured, power supply portions (not shown) for supplying voltages to the ion generating portions 751 and 752, and a box-like holder 753 for holding the ion generating portions 751 and 752 and the power supply portions. When the power supply portions supply voltages to the ion generating portions 751 and 752, corona discharge is generated between the ion generating portions 751 and 752. In this way, ions are generated. Specifically, this is a principle of generating positive ions and negative ions.

The ion generating portions 751 and 752 respectively include discharge-electrode projecting portions 751*a* and 752*a* each having a sharp shape, and annular induction electrodes 751*b* and 752*b* respectively surrounding the discharge-electrode projecting portions 751*a* and 752*a*. The discharge-electrode projecting portions 751*a* and 752*a* are arranged respectively at central portions of the annular induction electrodes 751*b* and 752*b*, and the one ion generating portion 751 generates positive ions, and the another ion generating portion 752 generate negative ions.

A positive voltage is applied to the positive-ion generating portion 751, and water molecules in the air are electrically decomposed in a plasma region generated by electrical discharge, and hydrogen ions $H^+$ are mainly generated. Then, the water molecules in the air aggregate around the hydrogen ions thus generated. As a result, positively charged stable cluster ions $H^+(H_2O)_m$ are formed.

A negative voltage is applied to the negative-ion generating portion 752, and oxygen molecules in the air are electrically decomposed in a plasma region generated by electrical discharge, and oxygen ions $O_2^-$ are mainly generated. Then, the water molecules in the air aggregate around the oxygen ions thus generated. As a result, negatively charged stable cluster ions $O_2^-(H_2O)_n$ are formed. Note that, m and n are each an arbitrary integer number.

Herein, the expression "positive ions" represents positive cluster ions, and the expression "negative ions" represents negative cluster ions. Note that, generation of the positive and negative cluster ions has been confirmed by time-of-flight mass spectrometry analysis.

When being simultaneously discharged into the air, positive ions and negative ions aggregate on surfaces of microbes such as bacteria, mold, and viruses, and then surround them. Then, instantaneously, the positive ions and negative ions bond to each other, and [.OH] (hydroxyl radical) which is an active species having markedly high oxidizing power and $H_2O_2$ (hydrogen peroxide) are generated through aggregation on the surfaces of the microbes. After that, protein on the surfaces of the microbes is decomposed by chemical reactions, and a function thereof is suppressed. The hydroxyl radical and the hydrogen peroxide generated as described above also have an effect of decomposing odor components.

As illustrated in FIG. 5, a through-hole 71*g* to face the ion generating portions 751 and 752 is formed in a surrounding portion of an upper wall of the cylindrical portion 71*d* of the blower box 71. A positioning protrusion 71*h* and an engagement claw 71*j* are provided to protrude around the through-hole 71*g*. The ion generator 75 is mounted to the blower box 71 by fitting the holder 753 to an inner side of the positioning protrusion 71*h* and engaging the engagement claw 71*j* with an engagement step 753*a* on a side surface of the holder 753. At this time, the ion generating portions 751 and 752 face the circular-arc flow path 71*e* (refer to FIG. 6) through the through-hole 71*g*.

In other words, the ion generator 75 is arranged in an upper portion of the circular-arc flow path 71*e* in a manner that the ion generating portions 751 and 752 (electrical discharge regions) are directed downward. With this, even when washing water overflows or scatters on an upper side or a lateral side on the outside of the drying unit K, the electrical discharge regions of the ion generator 75 do not get wet. Thus, the ions can be stably generated.

As illustrated in FIG. 6, the ion generator 75 is arranged in the wide downstream portion of the circular-arc flow path 71*e*, in which the space for installing additional components is easily secured and air flows at high speed, in a manner that distances from a rotation center of the blower fan 73 to the positive-ion generating portion 751 and to the negative-ion generating portion 752 are different from each other. More specifically, orientation is made such that a distance L1 from the rotation center of the blower fan 73 to the positive-ion generating portion 751 arranged on the upstream side of the circular-arc flow path 71*e* is short, and that a distance L2 from the rotation center of the blower fan 73 to the negative-ion generating portion 752 arranged on a downstream side of the circular-arc flow path 71*e* is long.

Therefore, positive ions and negative ions are generated in the circular-arc flow path 71*e* while being shifted on track from each other. In addition, the distance from the rotation center of the blower fan 73 to the positive-ion generating portion 751 on the upstream side is short, and the distance from the rotation center of the blower fan 73 to the negative-ion generating portion 752 on the downstream side is long. Thus, the space-saving ion generator 75 can be arranged along a flowing direction in the gradually widened circular-arc flow path 71*e*. Thus, the space-saving ion generator 75 can be arranged in the drying unit K, and simultaneously, positive ions and negative ions are prevented from being neutralized and eliminated. As a result, ions can be efficiently carried by a high-speed airflow.

As illustrated in FIG. 5, the vent 71*f* is provided as a nozzle projecting upward with respect to the upper wall of the blower box 71. The vent 71*f* is opened to the flow path on a downstream side of the ion generator 75. The air-outlet tube 81 having the air-outlet port 81*a* to face the space outside the machine is connected to the vent 71*f* by fitting. The air-outlet tube 81 forms the air-exhaust path (blower path) leading to the outside of the machine. In other words, the vent 71*f* forms the air-exhaust-path branching means for branching the air-exhaust path leading to the dewatering tub 30 and the air-exhaust path leading to the outside of the machine. A sectional area of the flow path in the duct 71*c* (air-exhaust path leading to the dewatering tub 30) is set to be larger than a sectional area of the air-outlet tube 81 (air-exhaust path leading to the outside of the machine). A bottom surface of the flow path in the duct 71*c* is formed to have a gradient of becoming lower from immediately below the vent 71*f* toward the air-exhaust port 71*b*.

The damper 76 is provided to open and close the vent 71*f*. As illustrated in FIG. 5, the damper 76 is provided to be driven by the damper control motor 77 supported on the outside of the peripheral wall of the cylindrical portion 71*d*, and to be turnable within a predetermined angular range in which a rotary shaft thereof is horizontal in the blower box 71. In this embodiment, a stepping motor is suitably used as the damper control motor 77. The damper 76 and the damper control motor 77 form the air-exhaust-path switching means for switching the air-exhaust path leading to the dewatering tub 30 and the air-exhaust path leading to the outside of the machine.

A groove 71*k* in conformity with a shape of the damper 76 is formed in the upper wall of the cylindrical portion 71*d* of the blower box 71 in a manner that the vent 71*f* is included in a region of the groove 71*k*. At a position at which the damper 76 closes the vent 71*f*, the damper 76 is accommodated in the groove 71*k*. With this, a flow in the circular-arc flow path 71*e* is not hindered by an obstacle, and the vent 71*f* is reliably closed.

The damper 76 has a cut surface 76*a* formed on one side along a curvature of an outer periphery of the blower fan 73, and arranged in an orientation in which the cut surface 76*a* comes close to the outer periphery of the blower fan 73. With this, the damper 76 can be arranged in a vicinity of the outer periphery of the blower fan 73 without hindering rotation of the blower fan 73, which contributes to space saving.

Further, the damper 76 is controlled by the damper control motor 77 so as to turn at angles of taking a first posture of closing the vent 71*f* and opening the air-exhaust path leading to the dewatering tub 30 as illustrated in FIG. 4(*a*), a second posture of opening the vent 71*f* and closing the air-exhaust path leading to the dewatering tub 30 as illustrated in FIG. 4(*b*), and a third posture of being positioned between the first posture and the second posture as illustrated in FIG. 4(*c*).

The second posture of FIG. 4(*b*) is set to be taken at a turning angle equal to or smaller than 90° with reference to the first posture of FIG. 4(*a*), specifically, at an angle at which an airflow to pass through the vent 71*f* flows at a maximum speed at the outlet. The angle varies depending on the shape of the blower box 71 and a position of the vent 71*f*, and is determined by a fluidizing experiment. Thus, when the damper 76 is kept at the angle of taking the second posture, the air containing ions to be discharged to the space outside the machine flows at a higher (maximum) speed, and hence the ions can be far spread.

Figure 8:
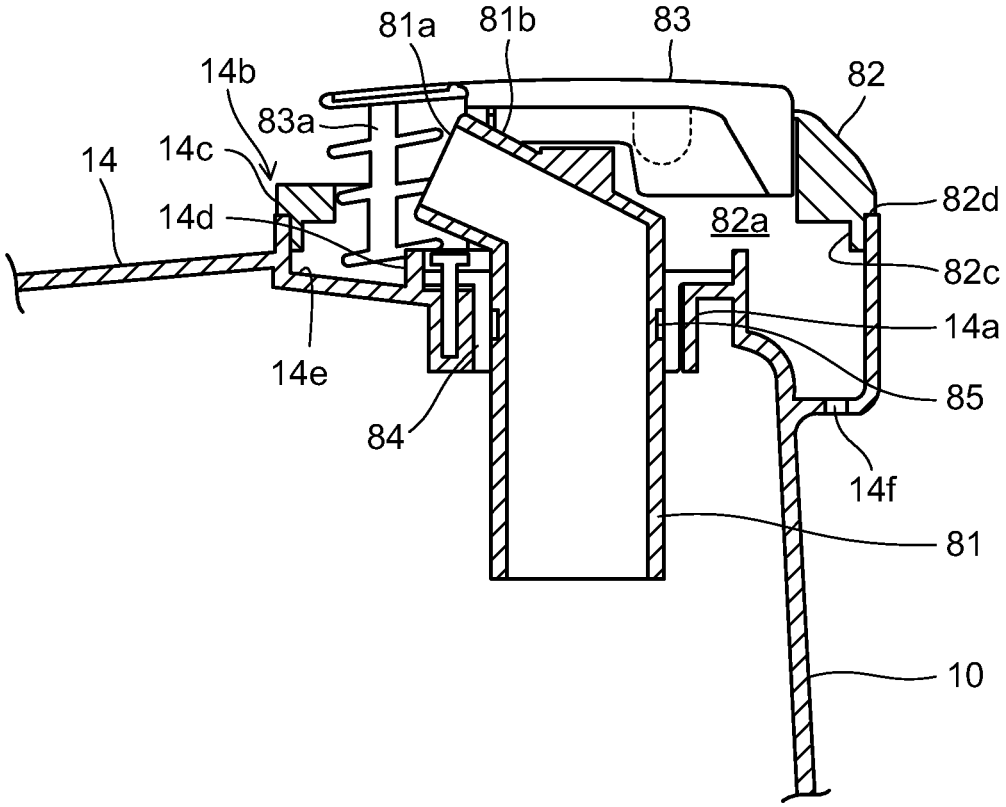
FIG. 8 is a detailed vertical sectional view in which a structure of a main part around an air-outlet port of the washing and drying machine is viewed from a lateral side.

FIG. 8 is a detailed vertical sectional view in which a structure of a main part around the air-outlet port of the washing and drying machine is viewed from a lateral side. As illustrated in FIG. 8, the air-outlet tube 81 includes a nozzle portion 81*b* provided in an upper portion thereof and bent forward, and the air-outlet port 81*a* is opened at a distal end of the nozzle portion 81*b*. A disk body 82 is provided to hold the air-outlet tube 81, and is fixed with screws around the nozzle portion 81*b*. With respect to the disk body 82, a nozzle cover 83 as an air-outlet-port cover is axially supported by a horizontal shaft.

A void 82*a* is formed by opening a front surface, an upper surface, and a lower surface of the disk body 82. In the void 82*a*, the nozzle portion 81*b* of the air-outlet tube 81 is accommodated and the nozzle cover 83 is arranged. An upper surface portion of the nozzle cover 83 comes to a position of an upper surface open portion of the void 82*a* and closes the same, and a diffuser 83*a* comes to a position of a front surface open portion of the void 82*a* and closes the same. However, a lower surface open portion of the void 82*a* is not closed because a lower surface of the nozzle cover 83 is opened. Shaft holes (not shown) are opened through side walls on the left and right of the void 82*a*.

The disk body 82 includes a nozzle 82*c* surrounding the lower surface open portion and a flange portion 82*d* surrounding the nozzle 82*c*, the flange portion 82*d* being formed at a peripheral portion on a lower surface thereof by forming the nozzle 82*c* with a diameter somewhat smaller than a diameter of the disk body as a whole. The nozzle 82*c* is loosely fitted to an inner periphery of a support wall 14*c*, and the flange portion 82*d* is supported at an upper end of the support wall 14*c*. In this way, the disk body 82 is mounted to a disk-body receiving portion 14*b*.

The nozzle cover 83 is formed into a box-like shape in which a lower surface is opened, and the diffuser 83*a* for diffusing ion wind blown out from the air-outlet port 81*a* is provided in the front surface of the nozzle cover 83. Horizontal shafts (not shown) are projected from side surface portions on both the left and right of the nozzle cover 83. By fitting the horizontal shafts into the shaft holes provided through the side walls of the void 82*a*, the nozzle cover 83 is disposed tiltably with respect to the disk body 82. The diffuser 83*a* faces the air-outlet port 81*a*.

The cup-like disk-body receiving portion 14*b*, which has an insertion hole 14*a* provided at a center thereof, is provided integrally with the back panel 14. The disk-body receiving portion 14*b* includes the annular support wall 14*c* for supporting the disk body 82 at the flange portion 82*d* and an annular bank wall 14*d* circumferentially provided on an inner side of the support wall 14*c* and surrounding the insertion hole 14*a*. In a bottom surface of the disk-body receiving portion 14*b*, which corresponds to a part surrounded by the support wall 14*c* and the bank wall 14*d*, there is formed a water path 14*e* for water intruding into the void in the disk body 81. The water path 14*e* is formed to have a gradient of becoming lower rearward. A drain hole 14*f* to be opened to the outside of the machine is provided at a lowest position on the gradient.

Thus, even when water intrudes into the void 82*a* in the disk body 82 from a gap between the nozzle cover 83 and the disk body 82 and from the diffuser 83*a*, as long as the water does not exceed the height of the bank wall 14*d*, the water is drained from the drain hole 14*f* to the outside of the machine through the water path 14*e* of the disk-body receiving portion 14*b*. Therefore, the water is prevented from intruding into the drying unit K. Further, the bottom surface of the flow path in the duct 71*c* is formed to have a gradient of becoming lower from immediately below the vent 71*f* toward the air-exhaust port 71*b*. Thus, even when water in the water path 14*e* overflows the bank wall 14*d* and intrudes into the drying unit K through the air-outlet tube 81, or when water jumps directly into the air-outlet port 81*a* from the diffuser 83*a* and then similarly intrudes into the drying unit K through the air-outlet tube 81, water that has dropped immediately below the vent 71*f* flows down to the air-exhaust port 71*b* through a space formed between the lower end of the heater 80 and the bottom surface of the duct 71*c* along the gradient of the bottom surface of the flow path in the duct 71*c*. Then, the water is drained from the air-exhaust port 71*b* into the dewatering tub 30. Thus, the drying unit K is prevented from suffering from failures such as immersion of the heater 80 into water pooled in the flow path.

The insertion hole 14*a* is a nozzle projected downward, and a fixing tube 84 for positioning the air-outlet tube 81 is mounted into the insertion hole 14*a* by fitting and with screws. An O-ring 85 for sealing the air-outlet tube 81 is fitted along an inner periphery of the fixing tube 84. The vent 71*f* of the drying unit K is positioned immediately below the insertion hole 14*a*. When the air-outlet tube 81 combined with the disk body 82 and the nozzle cover 83 is fitted through the fixing tube 84, the air-outlet tube 81 is connected to the vent 71*f* by fitting.

Figure 9A:
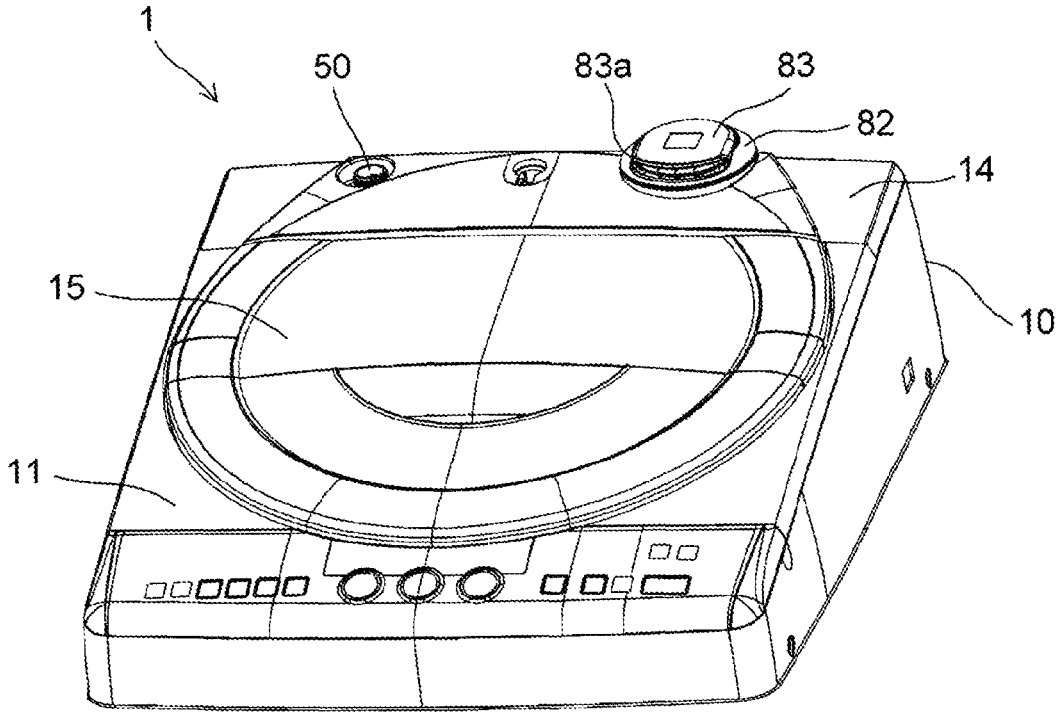
FIG. 9 are perspective views in each of which the front of a top plate of an outer casing of the washing and drying machine is obliquely viewed. Specifically, FIG. 9(*a*) illustrates a state in which a nozzle cover is pushed down, and FIG. 9(*b*) illustrates a state in which the nozzle cover is pulled up.
Figure 9B:
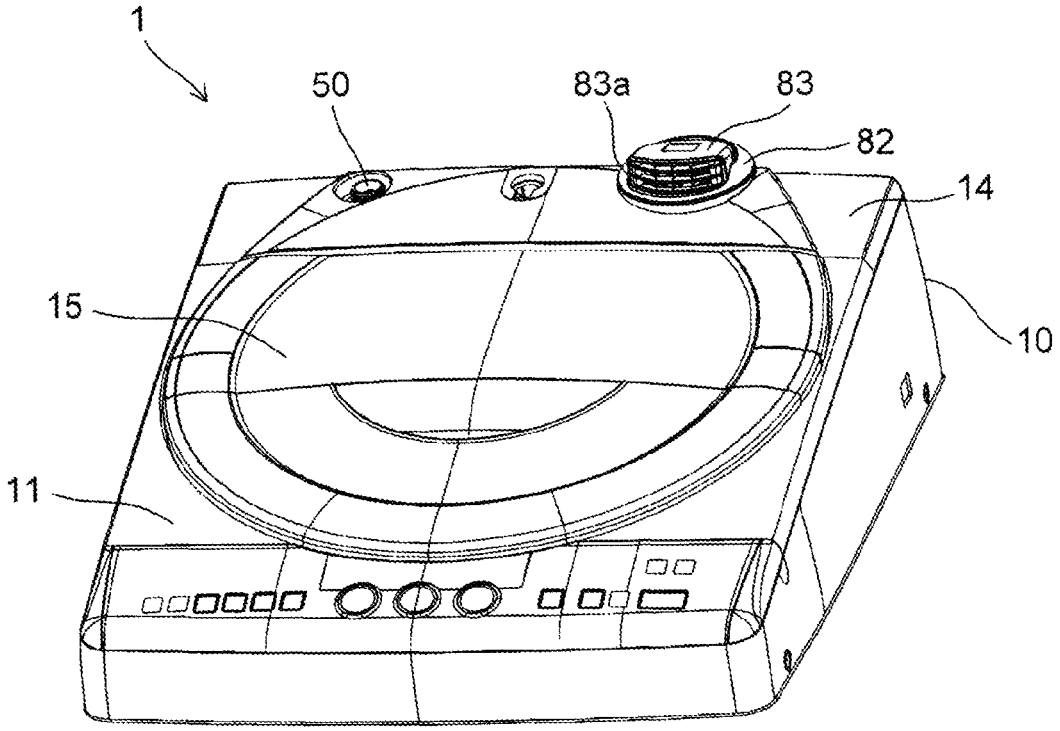
Figure 10:
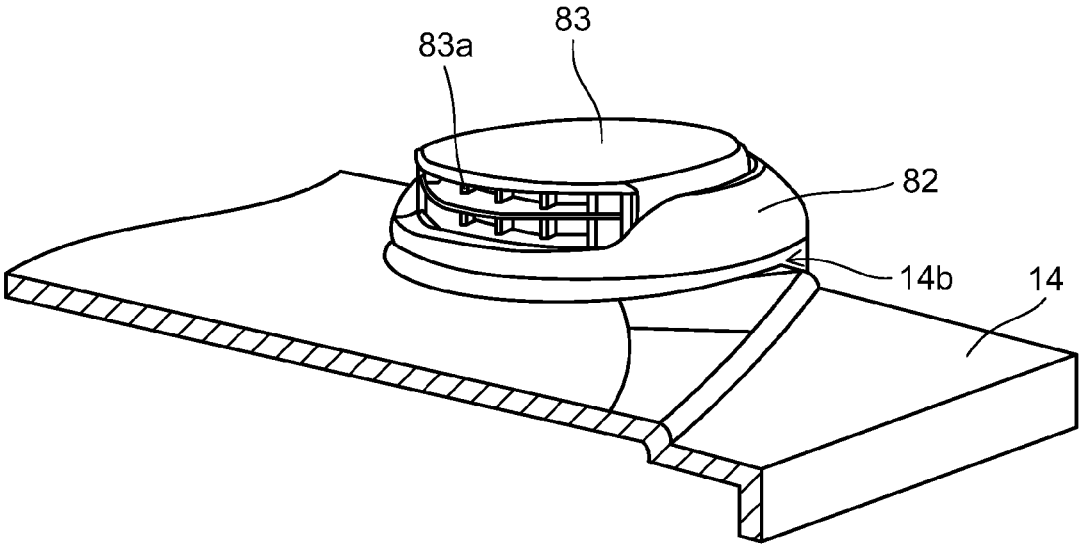
FIG. 10 is a main-part enlarged view of FIG. 9(*a*).

FIG. 9 are perspective views in each of which the front of the top plate of the outer casing of the washing and drying machine is obliquely viewed. Specifically, FIG. 9(*a*) illustrates a state in which the nozzle cover is pushed down, and FIG. 9(*b*) illustrates a state in which the nozzle cover is pulled up. FIG. 10 is a main-part enlarged view of FIG. 9(*a*).

In this embodiment, the nozzle cover 83 is tiltable. When the nozzle cover 83 is manually tilted, an elevation angle of the diffuser 83*a* is changed. As illustrated in FIGS. 9(*a*) and 10, under the state in which the nozzle cover 83 is pushed down, the diffuser 83*a* is directed in a horizontal direction. In addition, a lower half of the diffuser 83*a* hides in the disk body 82, and an exposed area of the diffuser 83*a* is halved. Thus, ion wind flowing at high speed in a horizontal direction is mainly blown out, which is suitable for sending ions to far spots.

As illustrated in FIG. 9(*b*), when the nozzle cover 83 is pulled up, the diffuser 83*a* is directed obliquely upward, and the diffuser 83*a* is exposed as a whole. Thus, ion wind is blow out from the diffuser 83*a* positioned at a height of the top plate of the outer casing (approximately 100 cm above a floor) in a diffused manner over a wide range. Thus, this state is suitable for uniformly distributing ions to the overall space.

Further, the disk body 82 is horizontally turnable at 360°. When the disk body 82 is manually turned, the air-outlet tube 81 and the nozzle cover 83 which are held by the disk body 82 turn together. Thus, a directional angle of the air-outlet port 81*a* is variable at 360°. In combination with tilting of the nozzle cover 83, a perpendicular angle of the diffuser 83*a* is changed, and hence ion wind can be blown out into an arbitrary direction.

With reference to FIGS. 3 and 4, description is made of ion-blowing operation for performing sterilization and deodorization in the dewatering tub and outside the machine, the ion-blowing operation being performed by the washing and drying machine structured as described above according to this embodiment.

<In-Tub Ion-Blowing Operation>

When the blower fan 73 is rotated under the state in which the damper 76 is kept at the first posture as illustrated in FIG. 4(*a*), air is taken into the blower box 71 along an arrow a direction of FIG. 3(*a*). In accordance therewith, the blower means 70 introduces the outside air into an arrow b direction from the open portion 17, and introduces the inside air into an arrow c direction from the through-hole 13. The air is taken into the air-intake port 71*a* via the air-introducing port 93 of the foreign-matter accommodating box 90, the inside of the foreign-matter accommodating box 90, and the filter 100 in the stated order. At this time, foreign matter such as dust contained in the air thus taken in is removed at the time of passing through the filter 100, and adheres to and accumulates on a lower surface (inlet-side surface) of the filter 100. The foreign matter accumulated on the filter 100 drops into the foreign-matter accommodating box 90, for example, by vibration during operation, with the result of being accommodated in the foreign-matter accommodating box 90.

Positive ions and negative ions generated from the ion generator 75 are mixed into the air to be blown by the blower fan 73. In this way, ion wind is generated. The ion wind flows along an arrow d direction in the flow path in the duct 71*c*, and then is sent as indicated by an arrow e from the bellows tube 74 into the dewatering tub 30. In this way, the space inside the machine can be purified, and hence development of mold in the dewatering tub 30 and odor inside the machine can be suppressed. After that, the ion wind is discharged from the exhaust air filter 23 to the outside of the dewatering tub 30. Note that, the in-tub ion-blowing operation may be performed in an independent-operation mode independent of an operation of washing, dewatering, or drying, may be performed during the operation of washing, dewatering, or drying, or may be performed after the operation of washing or drying is finished.

<Outward Ion-Blowing Operation>

Under the state in which the damper 76 is kept at the second posture as illustrated in FIG. 4(*b*), ion wind flows in the air-outlet tube 81 in an arrow f direction of FIG. 4(*b*), and then sent as indicated by an arrow g of FIG. 3(*b*) from the air-outlet tube 81 into the space outside the machine. In this way, a sanitary space, such as the lavatory, in which the washing and drying machine is installed can be purified, and hence development of mold on a wall and odor outside the machine can be suppressed. Note that, the outward ion-blowing operation may be performed in an independent-operation mode independent of an operation of washing, dewatering, or drying, may be performed during the operation of washing, dewatering, or drying, or may be performed after the operation of drying is finished.

<In-Tub-and-Outward Ion-Blowing Operation>

Under the state in which the damper 76 is kept at the third posture as illustrated in FIG. 3(*c*), the ion wind flows along an arrow h direction of FIG. 4(*c*) in the flow path in the duct 71*c*, and then is sent as indicated by an arrow k into the dewatering tub 30. Simultaneously, the ion wind flows along an arrow j direction in the air-outlet tube 81, and then is sent as indicated by an arrow m to the space outside the machine. With this, sterilization and deodorization can be simultaneously performed both inside and outside the machine, and hence running cost can be reduced in comparison with that in the case where the in-tub ion-blowing operation and the outward ion-blowing operation are independently and successively performed. In this context, the sectional area of the flow path in the duct 71*c* (air-exhaust path leading to the dewatering tub 30) is set to be larger than the sectional area of the air-outlet tube 81 (air-exhaust path leading to the outside of the machine), and hence more ions can be discharged into the dewatering tub 30 than the ions to be discharged outside the machine. As a result, sterilization and deodorization of the dewatering tub 30 can be performed preferentially to those of the space outside the machine.

Figure 11:
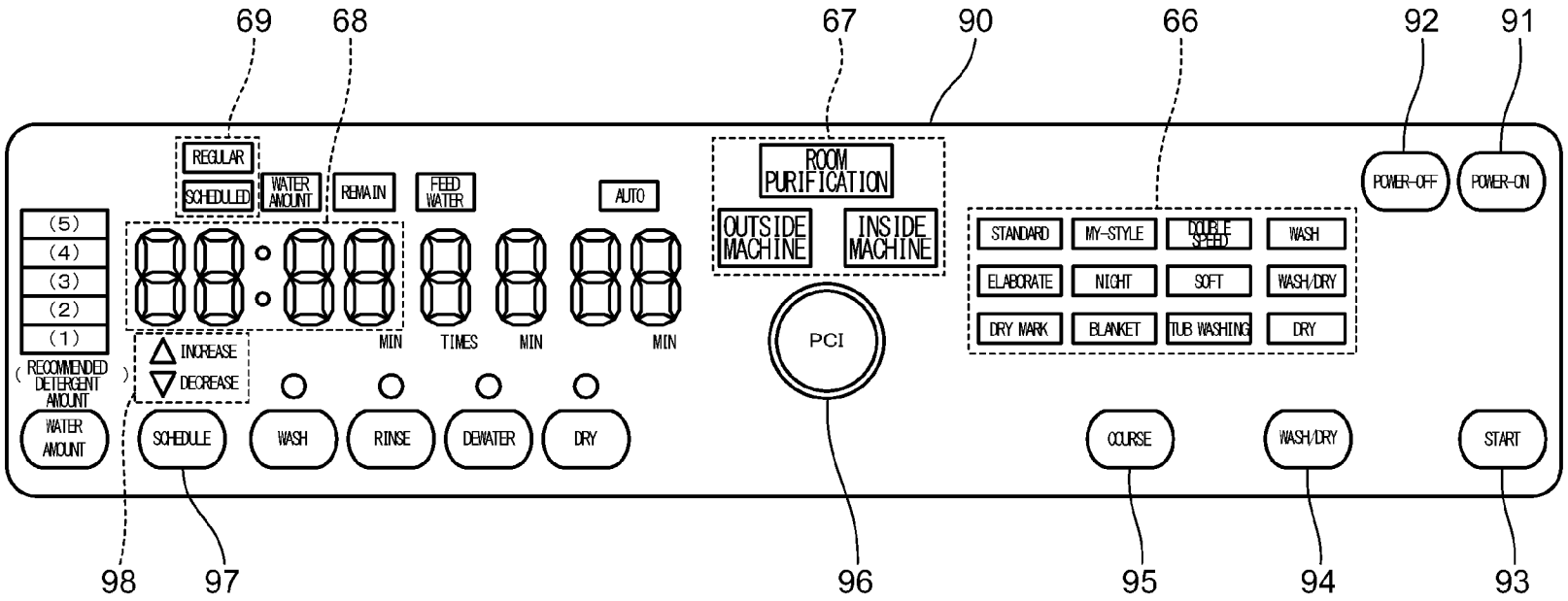
FIG. 11 is an explanatory diagram illustrating an external appearance of an operating portion.

FIG. 11 is an explanatory diagram illustrating an external appearance of the operating portion 90. The operating portion 90 includes operation buttons such as a start key 93, a power-on key 91, a power-off key 92, a wash/dry switching key 94, a course key 95, a room purification key 96, a scheduling key 97, and time setting keys 98, and LED display lamps such as course display lamps 66, room-purification display lamps 67, a time display lamp 68, and regular-operation display lamps 69. Operations with respect to the operation buttons are input to the control circuit 51, and display contents of the display lamps are updated in accordance with the operations accepted by the control circuit 21 and progress of washing, rinsing, dewatering, and drying.

Figure 12:
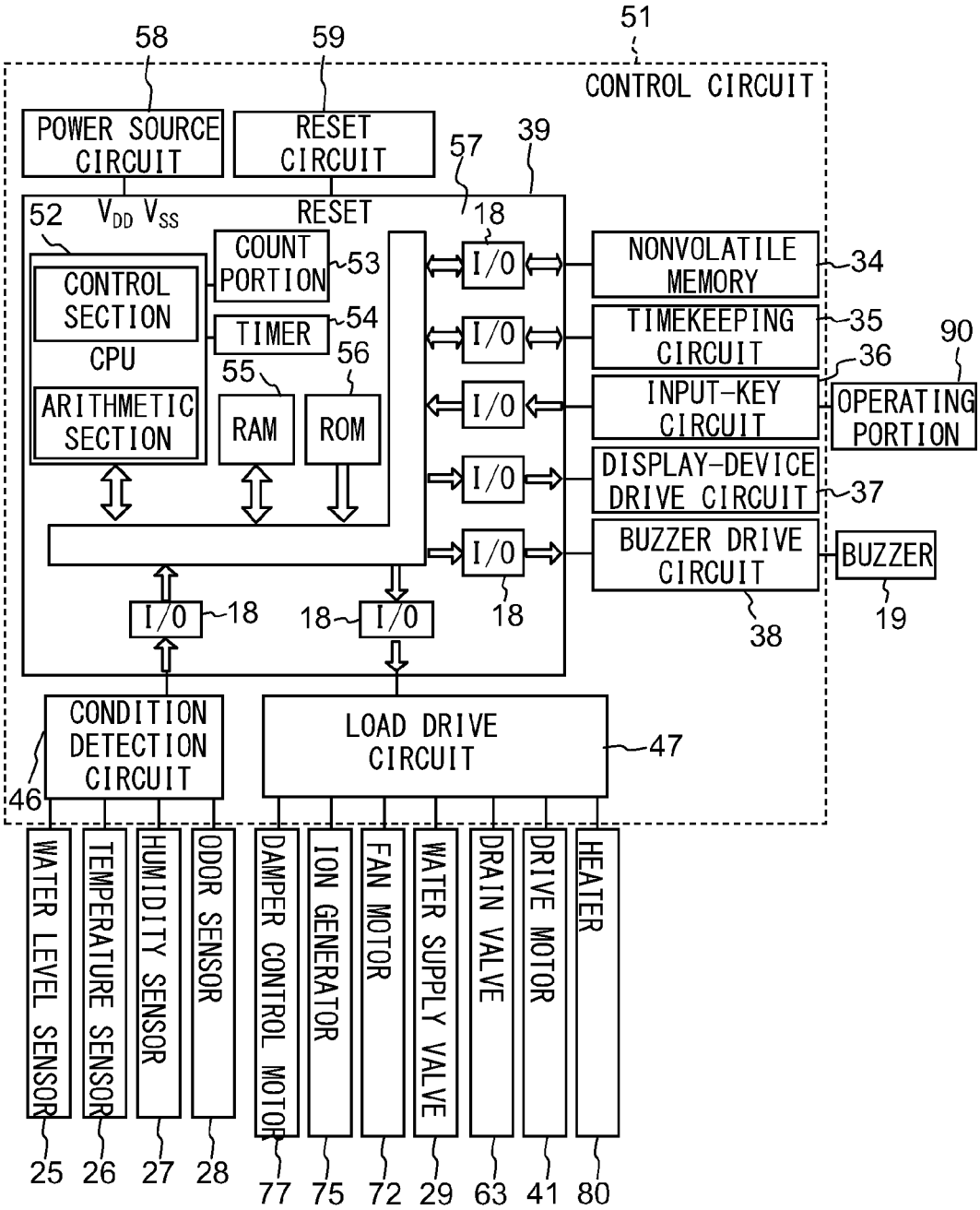
FIG. 12 is a block diagram illustrating a schematic configuration of a control circuit.

FIG. 12 is a block diagram illustrating a schematic configuration of the control circuit. A CPU 52 of a microcomputer 39 is a core of the control circuit 21. The microcomputer 39 includes the CPU 52, a RAM 55, a ROM 56, a count portion 53, a timer 54, a system bus 57, and a plurality of I/O ports 18. The CPU 52, the RAM 55, the ROM 56, and the I/O ports 18 are connected to one another via the system bus 57. The count portion 53 and the timer 54 are connected directly to the CPU 52.

The CPU 52 is formed of a control section 64 and an arithmetic section 65. The control section 64 reads out control programs pre-stored in the ROM 56 and decodes and executes a command. After that, the control section 64 stores temporarily generated date into the RAM 55. The arithmetic section 65 performs operations such as binary addition and subtraction, a logic operation, and comparison with respect to the data read out from the RAM 55 and data input from the I/O ports 18. Further, in the ROM 56, means for activating various control-subject devices, conditions set for various determinations, rules for controlling various information pieces are stored as fixed data.

To the plurality of I/O ports 18 of the microcomputer 39, there are connected a nonvolatile memory 34, a timekeeping circuit 35, an input-key circuit 36, a display-device drive circuit 37, a buzzer drive circuit 38, a condition detection circuit 46, and a load drive circuit 47. The operation buttons of the operating portion 90 are connected to the input-key circuit 36, and the display lamps of the operating portion 90 are connected to the display-device drive circuit 37. A buzzer 19 which issues an operation/alarm sound and the like is connected to the buzzer drive circuit 38. The timekeeping circuit 35 is provided for timekeeping. To the condition detection circuit 133, there are connected sensors such as a water level sensor 25 for detecting a water level in the dewatering tub 30, a temperature sensor 26 for detecting temperature outside the machine, a humidity sensor 27 for detecting humidity outside the machine, and an odor sensor 28. The condition detection circuit 46 includes a circuit for converting signals from those sensors to digital signals. The load drive circuit 136 drives a water supply valve 29, the drain valve 63, the drive motor 41, the fan motor 72, the ion generator 75, the damper control motor 77, and the heater 80.

The microcomputer 39 is activated with predetermined voltages supplied from a power source circuit 58 to power source terminals $V_{dd}$ and $V_{ss}$, and is reset with a RESET signal input from a reset circuit 59. When a user turns on power by pressing the power-on key 91, a standard course is set by initial setting of the CPU 52. In this state, every time the wash/dry switching key 94 is pressed, it is switched whether a washing operation from washing to dewatering ("STANDARD" and "WASH" of the course lamps 66 are lit) is executed or a washing and drying operation from washing to drying ("STANDARD" and "WASH/DRY" of the course lamps 66 are lit) is executed. Courses are switched every time the course key 95 is pressed. In accordance therewith, lit points of the course display lamps 66 varies. In the following, for the sake of simplicity in description, the standard course is exemplified.

The room purification key 96 is a key as operation-mode switching means for switching settings of operation modes of the ion-blowing operations. In other words, every time the room purification key 96 is pressed, it is switched whether or not the ion-blowing operation after the washing operation or the washing and drying operation is finished (hereinafter, also referred to as room purification step) is executed. In accordance therewith, it is switched which of the room-purification display lamps 67 is lit or darkened. When the room purification step (hereinafter, also referred to as washing and room purification mode or washing and drying and room purification mode) is set, an initial setting of the blower paths is made such that the ion-blowing operation is performed "IN-TUB" after the washing operation is finished, and performed "OUTSIDE MACHINE" after the washing and drying operation is finished. Every time the wash/dry switching key 94 is pressed, "IN-TUB" and "OUTSIDE MACHINE" are switched. In accordance therewith, lit points of the room-purification display lamps 67 vary. Note that, the blower paths according to the initial setting cannot be changed. Then, by pressing the start key 93, the washing and room purification mode or the washing and drying and room purification mode (first operation mode) is started.

Further, every time the room purification key 96 is pressed for a long period of time of few seconds (what is called a long press), it is switched whether or not the independent-operation mode in which the ion-blowing operations are performed independently of the operation of washing, dewatering, or drying is performed (hereinafter, also referred to as room purification mode). When the room purification mode is set, the room-purification display lamps 67 are lit, and the course display lamps 66 are darkened. In addition, the room purification key 96 itself may be lit. An initial setting of the blower paths when setting the room purification mode is made such that the ion-blowing operation is performed "OUTSIDE MACHINE." The blower paths in this initial setting can be changed.

Even when the room purification step is not set, ions are blown into the dewatering tub 30 during execution of washing, rinsing, and dewatering steps in the washing operation, and also during execution of washing, rinsing, dewatering, and drying steps in the washing and drying operation.

In some cases, the room purification key 96 doubles as blower-path changing means for changing settings of the blower path leading to the dewatering tub or the outside the machine. In other words, every time the room purification key 96 is pressed (not a long press) after setting the room purification mode, a setting of "OUTSIDE MACHINE"/"IN-TUB" with respect to the blower paths is changed. Further, in accordance therewith, the lit points of the room-purification display lamps 67 vary. Further, when the room purification key 96 is pressed during execution of the washing operation or during execution of the washing step, the rising step, and the drying step in the washing and drying operation, the initial setting of "IN-TUB" with respect to the blower paths can be switched to "OUTSIDE MACHINE." Then, by pressing the start key 93, the room purification mode (second operation mode) is started.

The scheduling key 97 is a key for setting a scheduled operation of the washing operation or the washing and drying operation. When the scheduling key 97 is pressed under the state in which the room purification mode is set, a regular operation of the room purification mode (hereinafter, also referred to as regular room-purification mode) can be scheduled. In other words, the scheduling key 97 has a function of regular-operation setting means for scheduling regular execution of the room purification mode. Note that, by pressing the scheduling key 97 once more, the regular room-purification mode can be cancelled. By pressing the scheduling key 97, setting a disclosed time by operating the time setting key 98 (INCREASE key/DECREASE key) as time setting means, and then pressing the start key 93, the regular room-purification mode (third operation mode) is started.

Note that, even when the start key 93 is pressed immediately after the regular room-purification mode is set without setting the time, other regular room-purification modes (fourth to sixth operation modes) are started.

Description is made of the operation modes of the ion-blowing operations performed by the washing and drying machine according to the present invention. Hereinabove, description is made of details of the ion-blowing operations with reference to FIG. 3 and FIG. 4, and hence redundant description is omitted. In accordance with the operation modes, time periods for performing the ion-blowing operations are appropriately selected from time periods recorded in the ROM 56.

Figure 13:
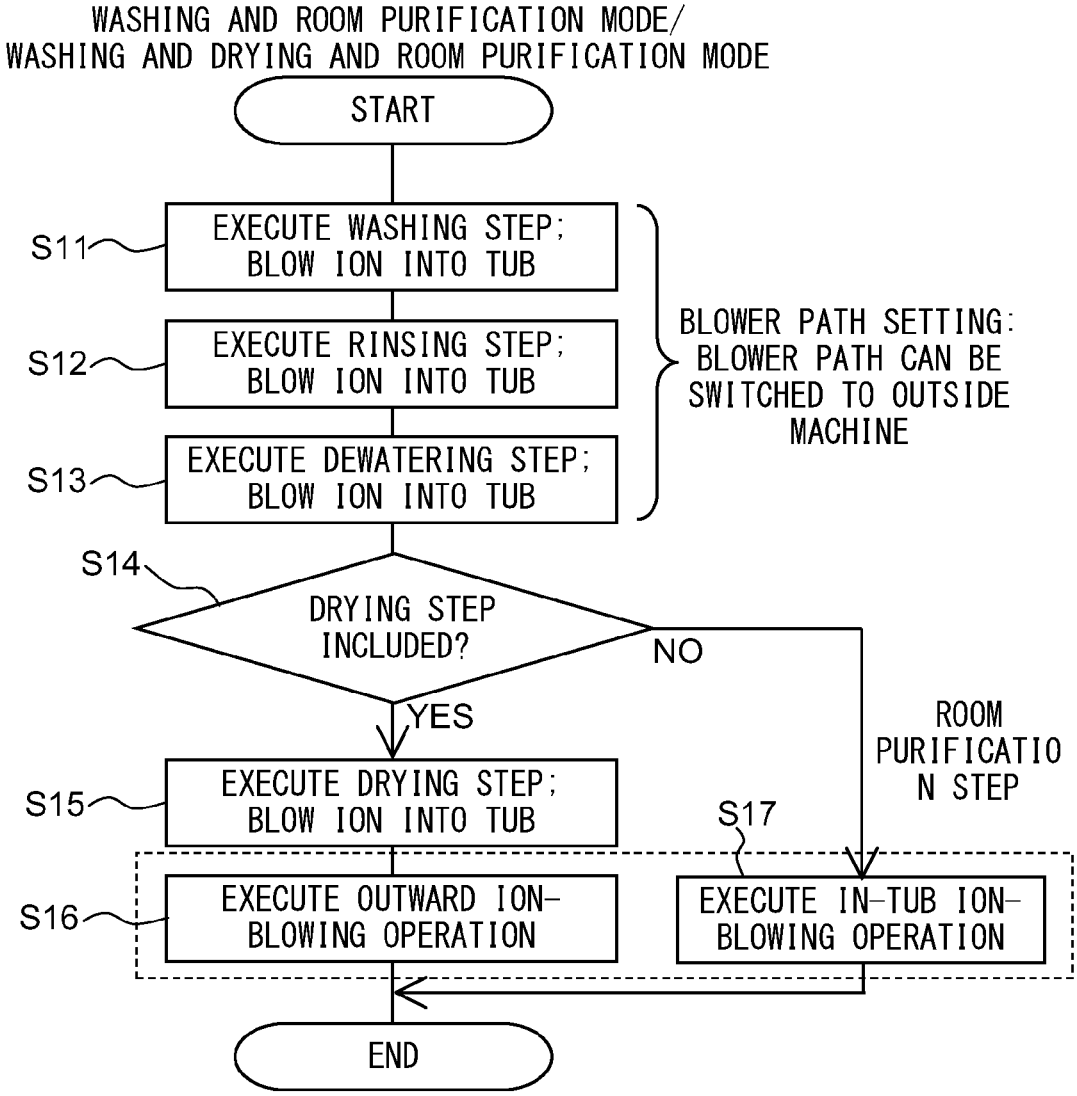
FIG. 13 is a flowchart illustrating a procedure for a first operation mode of the ion-blowing operations.

FIG. 13 is a flowchart illustrating a procedure for the first operation mode of the ion-blowing operations, specifically, the washing and room purification mode or the washing and drying and room purification mode. When the washing and room purification mode or the washing and drying and room purification mode is started as described above, the washing step is performed in Step S11, the rinsing step is performed in Step S12, and the dewatering step is performed in Step S13 in the stated order.

In the washing and drying and room purification mode (positive determination in Step S14), after the dewatering step, the drying step is performed in Step S15 (Step). During execution of the washing, rinsing, dewatering, and drying steps, the in-tub ion-blowing operation (refer to FIG. 3(*a*) and FIG. 4(*a*)) is simultaneously performed. Then, after the drying step, the outward ion-blowing operation as the room purification step (refer to FIG. 3(*b*) and FIG. 4(*b*)) is performed in Step S16.

In the washing and room purification mode in which the drying step is not executed (negative determination in Step S14), after the dewatering step, the in-tub ion-blowing operation as the room purification step (refer to FIG. 3(*a*) and FIG. 4(*a*)) is performed in Step S17.

According to the first operation mode, by automatically switching the blower paths, during execution of the washing, rinsing, dewatering, and drying steps, sterilization and deodorization of washing objects in the dewatering tub and the dewatering tub itself are performed. After the washing and drying operation is finished, sterilization and deodorization of an installation space for the washing and drying machine (outside the machine), such as a lavatory, can be performed. Thus, excellent usability is achieved. Further, as for the washing operation in which the drying step is not performed, it is possible to meet the demand of a user who wants to preferentially remove odor caused by humidity left in the dewatering tub and mold odor by performing sterilization and deodorization not outside of the machine but in the dewatering tub after the operation is finished. In addition, for example, when moisture and smell of soap from the bath are left in a lavatory as an installation space for the washing and drying machine, some user may want to perform sterilization and deodorization outside of the machine even during execution of the washing, rinsing, or dewatering step. Thus, the blower paths can be switched by an operation of a user, and hence the washing and drying machine can be used in accordance with various life situations.

Figure 14:
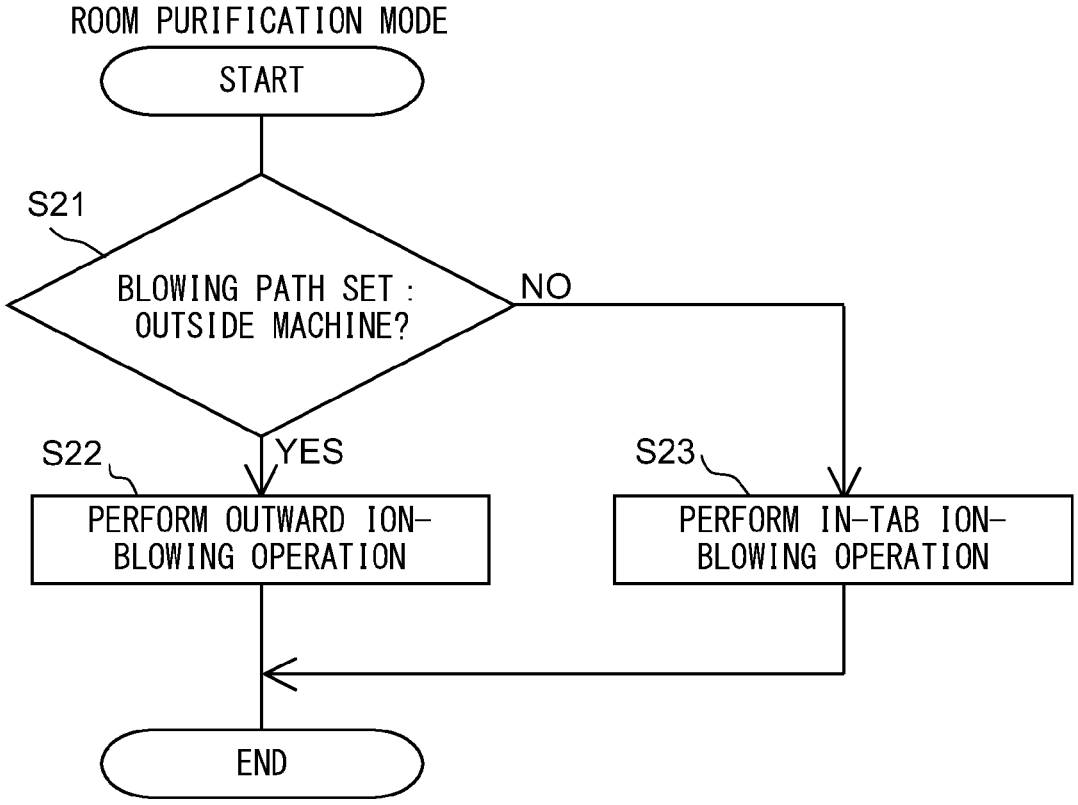
FIG. 14 is a flowchart illustrating a procedure for a second operation mode of the ion-blowing operations.

FIG. 14 is a flowchart illustrating a procedure for the second operation mode of the ion-blowing operations, specifically, the room purification mode. When the room purification mode is started as described above, in the case where the setting of "OUTSIDE MACHINE" (positive determination in Step S21) is made with respect to the blower path, the outward ion-blowing operation (refer to FIG. 3(*b*) and FIG. 4(*b*)) is performed in Step S22. Meanwhile, when the setting of "IN-TUB" (negative determination in Step S22) is made with respect to the blower path, the in-tub ion-blowing operation (refer to FIG. 3(*a*) and FIG. 4(*a*)) is performed in Step S23.

According to the second operation mode, there is provided a function of blowing ions to the outside of the machine or into the dewatering tub independently of the operation of washing, dewatering, and drying, and hence only sterilization and deodorization can be performed without performing the washing operation or the washing and drying operation. Thus, excellent usability is achieved, with the result that users' attention to health and cleanliness can be satisfied.

Figure 15:
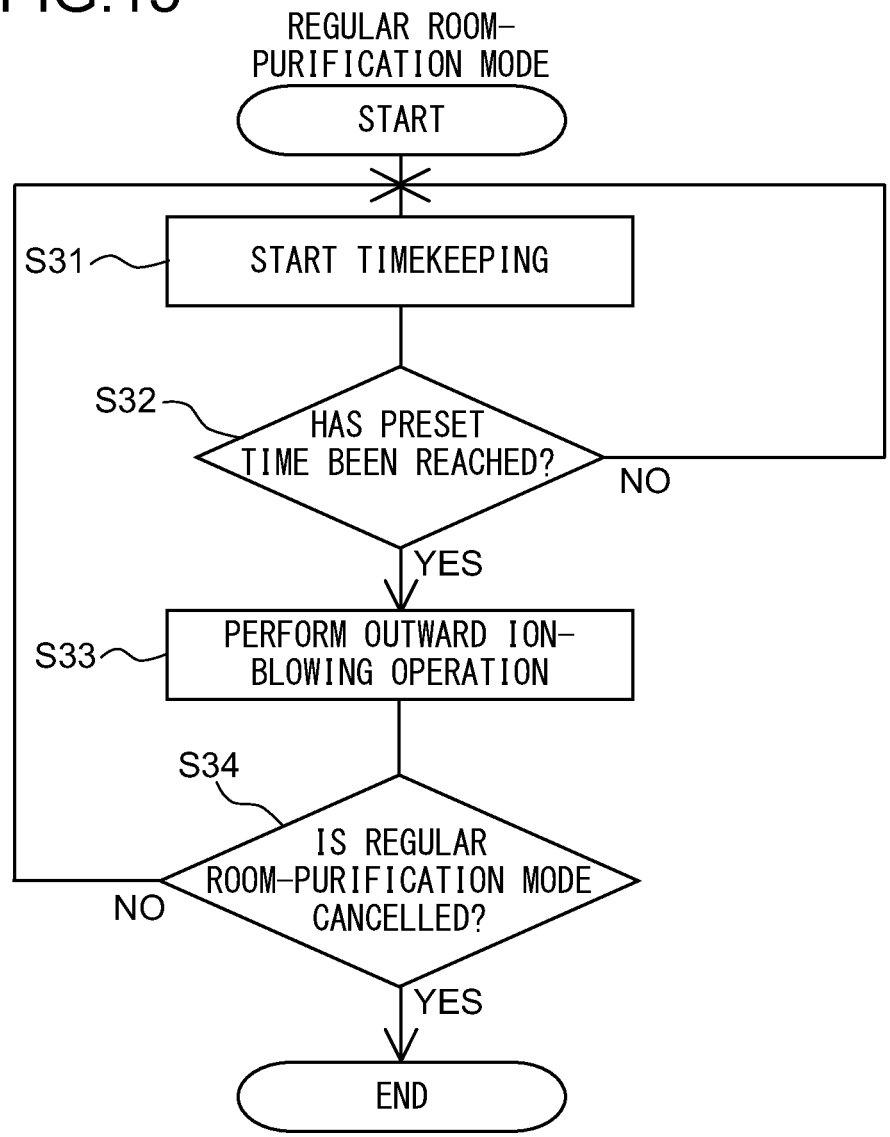
FIG. 15 is a flowchart illustrating a procedure for a third operation mode of the ion-blowing operations.

FIG. 15 is a flowchart illustrating a procedure for the third operation mode of the ion-blowing operations, specifically, an example of the regular room-purification modes. When the regular room-purification mode is started after time setting as described above, the timekeeping circuit 35 starts timekeeping in Step S31. When a starting time set by a user has been reached in Step S32, the outward ion-blowing operation is performed in Step S43. The outward ion-blowing operation is repeated until the regular room-purification mode is cancelled in Step S34.

Figure 16:
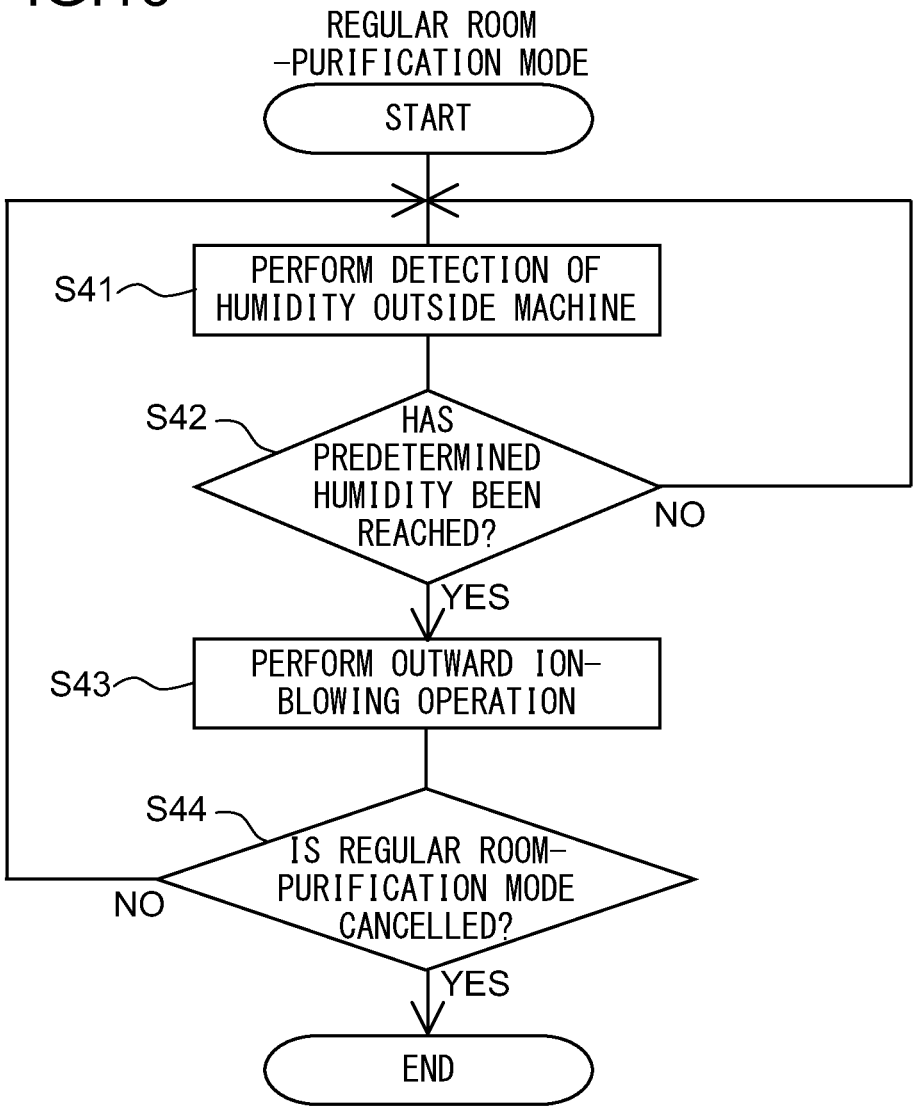
FIG. 16 is a flowchart illustrating a procedure for a fourth operation mode of the ion-blowing operations.

FIG. 16 is a flowchart illustrating a procedure for the fourth operation mode of the ion-blowing operations, specifically, another example of the regular room-purification modes. When the regular room-purification mode is started without setting the time as described above, the humidity sensor 27 starts detecting a humidity in the space outside the machine in Step S41. When a predetermined humidity has been detected in Step S32, the outward ion-blowing operation is performed in Step S43. Here, it is preferred that a humidity condition in which mold is considered to be liable to develop (for example, relative humidity of 70% to 99%) be set as the predetermined humidity. The outward ion-blowing operation is repeated until the regular room-purification mode is cancelled in Step S44.

Figure 17:
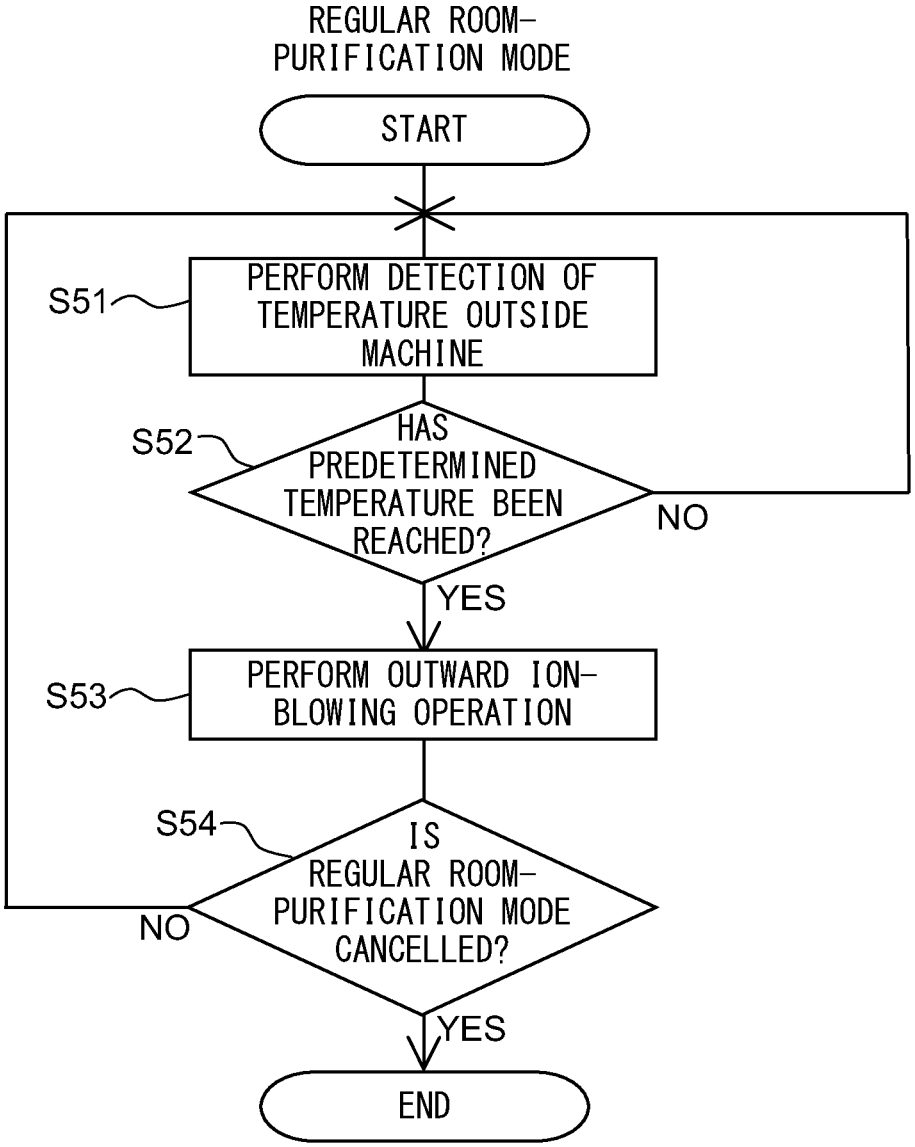
FIG. 17 is a flowchart illustrating a procedure for a fifth operation mode of the ion-blowing operations.

FIG. 17 a flowchart illustrating a procedure for the fifth operation mode of the ion-blowing operations, specifically, still another example of the regular room-purification modes. Instead of the detection of humidity in the space outside the machine, which is performed in the fourth operation mode, in the fifth operation mode, detection of temperature in the space outside the machine is performed by the temperature sensor 26 in Step S51. When a predetermined temperature has been detected in Step S52, the outward ion-blowing operation is performed in Step S53. Here, it is preferred that a room-temperature condition in which mold is considered to be liable to develop (for example, from 10° C. to 35° C.) be set as the predetermined temperature. The outward ion-blowing operation is repeated until the regular room-purification mode is cancelled in Step S54.

Figure 18:
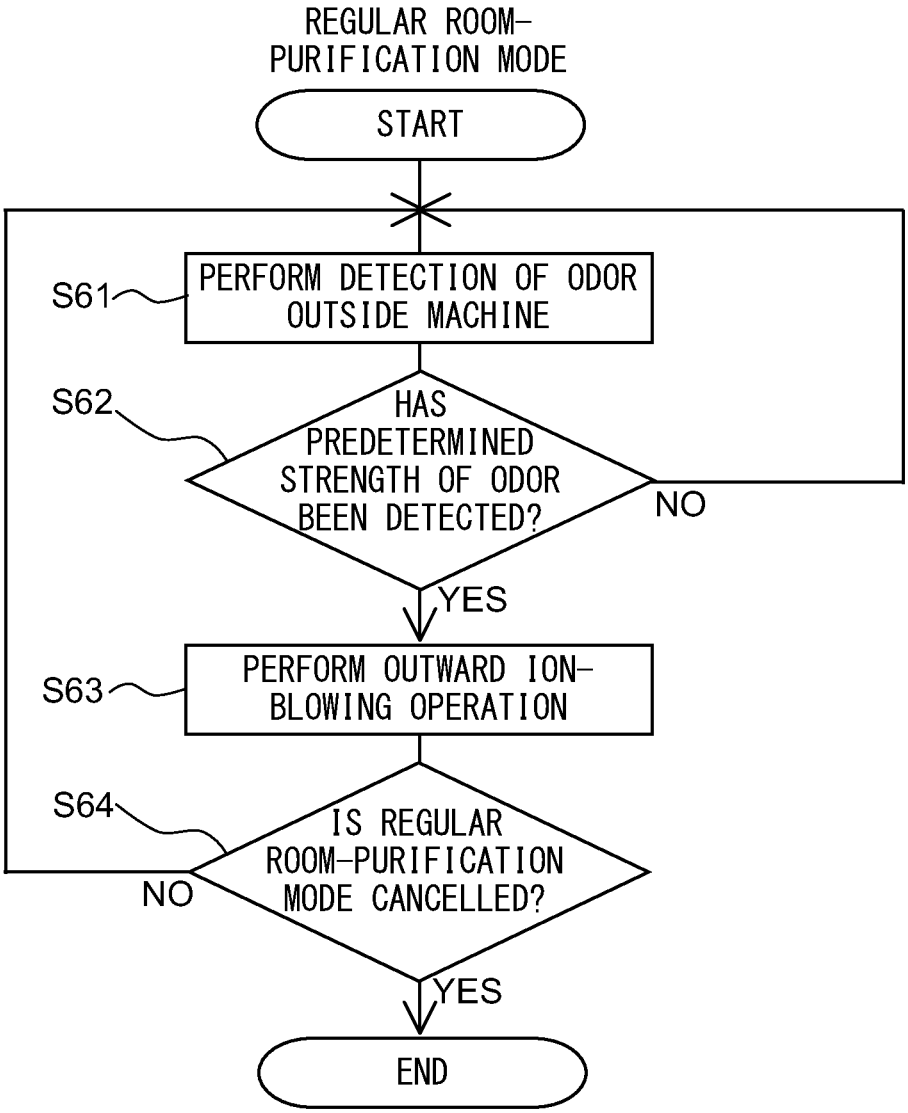
FIG. 18 is a flowchart illustrating a procedure for a sixth operation mode of the ion-blowing operations.

FIG. 18 a flowchart illustrating a procedure for the sixth operation mode of the ion-blowing operations, specifically, yet another example of the regular room-purification modes. Instead of the detection of humidity in the space outside the machine, which is performed in the fourth operation mode, in the sixth operation mode, detection of odor in the space outside the machine is performed by the odor sensor 28 in Step S61. When a predetermined odor has been detected in Step S62, the outward ion-blowing operation is performed in Step S63. The outward ion-blowing operation is repeated until the regular room-purification mode is cancelled in Step S64.

According to the third to sixth operation modes, there is provided a function of regularly blowing ions to the outside of the machine or into the dewatering tub. Specifically, the ion-blowing operations are performed every day at a preset time, or ions are blown when conditions of development of mold and generation of odor are established. Thus, excellent usability is achieved. Specifically, time and effort are saved for settings performed by users, and sterilization and deodorization outside the machine can be efficiently performed.

The scope of the present invention is not limited to the above-mentioned illustration. As for the first operation mode of the ion-blowing operations, there has been exemplified a case where the standard course is specified with the course key 95. However, also in the cases where other courses are specified, ions can be blown into the dewatering tub 30 during execution of the washing, rinsing, dewatering, or drying step, and the room purification steps can be executed after the courses are finished.

Further, the description has been made that, in the first operation mode of the ion-blowing operations, in the case where the room purification step is performed after the washing operation is finished, the in-tub ion-blowing operation is performed, and sterilization and deodorization in the dewatering tub are performed. Alternatively, similarly to the case where the washing and drying operation is finished, the outward ion-blowing operation may be performed to sterilize and deodorize the outside of the machine.

Still further, the description has been made that, in the fourth to sixth operation modes of the ion-blowing operations, the temperature sensor 26, the humidity sensor 27, and the odor sensor 28 respectively detect the temperature, humidity, and odor in the space outside the machine. Alternatively, the temperature, humidity, and odor in the dewatering tub 30 may be detected thereby.

Yet further, in the third to sixth operation modes of the ion-blowing operations, prior to main setting of the regular room-purification modes, the "IN-TUB" blower paths may be selectable as in the second operation mode. With this, sterilization and deodorization in the dewatering tub can also be regularly performed, and hence odor generated from dirty washing objects that have not yet been washed can be removed without involving time and effort.

Yet further, description is made of the case where the fourth to sixth operation modes of the ion-blowing operations are independent of each other. In this context, when two or more of the operation modes are arbitrarily used in combination, conditions of development of mold and generation of odor can be more reliably detected from a plurality of viewpoints. As a result, sterilization and deodorization outside the machine can be more efficiently performed.

INDUSTRIAL APPLICABILITY

The present invention is applicable to washing and drying machines.

REFERENCE SIGNS LIST

1 washing and drying machine
10 outer casing
14 back panel (top plate of outer case)
14*a* insertion hole
14*b* disk-body receiving portion
14*e* water path
71 blower box
71*a* air-intake port
71*b* air-exhaust port
71*e* circular-arc flow path
71*f* vent
72 fan motor (centrifugal fan)
75 ion generator
751 positive-ion generating portion
752 negative-ion generating portion
76 damper
80 heater
81 air-outlet tube
81*a* air-outlet port
82 disk body
83 nozzle cover (air-outlet-port cover)
83*a* diffuser
90 operating portion

The invention claimed is:

1. A washing and drying machine, comprising:
an outer casing;
a dewatering tub arranged in the outer casing;
a drying unit which is arranged in an upper portion in the outer casing, and includes a heater and a blower fan accommodated in a blower box having an air intake port and an air exhaust port, the blower fan being driven to deliver air heated by the heater into the dewatering tub via the air exhaust port;
an ion generator for generating ions having sterilizing and deodorizing actions into a first airflow path connecting an output of the ion generator with the dewatering tub via the air exhaust port, a second airflow path connecting the output of the ion generator with the space outside the washing and drying machine via a vent, or both the first and the second airflow paths, the ion generator being mounted to the blower box; and
an air outlet tube connected to the vent and having an air outlet port to substantially horizontally face a space outside the washing and drying machine,
wherein the vent is provided through the blower box and opened vertically toward the air outlet tube on a downstream side of the ion generator and on an upstream side of the heater,
wherein the air outlet tube is mounted to a top plate of the outer casing in an axially turnable manner.

2. A washing and drying machine according to claim 1,
wherein the air exhaust port is opened in a lower surface of the blower box, and
wherein a bottom surface of a flow path in the blower box is formed to have a gradient that becomes lower in a range from immediately below the vent toward the air exhaust port.

3. A washing and drying machine according to claim 1, further comprising:
a disk body for holding the air outlet tube; and
a disk body receiving portion formed on the top plate of the outer casing and having an insertion hole for the air outlet tube, the insertion hole being provided at a center thereof,
wherein the air outlet tube is passed through the insertion hole, and
wherein the disk body is turnably mounted to the disk body receiving portion.

4. A washing and drying machine according to claim 3, wherein the air exhaust port is opened in a lower surface of the blower box, and
wherein a bottom surface of a flow path in the blower box is formed to have a gradient that becomes lower in a range from immediately below the vent toward the air exhaust port.

5. A washing and drying machine according to claim 3, further comprising an air outlet port cover comprising a diffuser to face the air outlet port,
wherein the air outlet port cover is axially supported with respect to the disk body by a horizontal shaft.

6. A washing and drying machine according to claim 5, wherein the air exhaust port is opened in a lower surface of the blower box, and
wherein a bottom surface of a flow path in the blower box is formed to have a gradient that becomes lower in a range from immediately below the vent toward the air exhaust port.

7. A washing and drying machine according to claim 5,
wherein the disk body has a void in which a periphery of the air outlet port of the air outlet tube is accommodated, the void being formed by opening a lower surface of the disk body,
wherein the disk body receiving portion comprises:
an annular support wall for supporting an outer peripheral portion of the disk body; and
an annular bank wall circumferentially provided on an inner side of the annular support wall,
wherein the disk body receiving portion comprises a water path for water to intrude into the void in the disk body, the water path being formed in a bottom surface of a part of the disk body receiving portion, the part being surrounded by the annular support wall and the annular bank wall, and
wherein the disk body receiving portion comprises a drain hole to be opened to an outside of the washing and drying machine, the drain hole being formed at one point on the water path.

8. A washing and drying machine according to claim 7, wherein the air exhaust port is opened in a lower surface of the blower box, and wherein a bottom surface of a flow path in the blower box is formed to have a gradient that becomes lower in a range from immediately below the vent toward the air exhaust port.

* * * * *